United States Patent [19]

Kubodera et al.

[11] Patent Number: 4,690,883

[45] Date of Patent: Sep. 1, 1987

[54] IMAGE FORMING PROCESS

[75] Inventors: Seiiti Kubodera; Masaki Okazaki, both of Minami-ashigara, Japan

[73] Assignees: Fuji Photo Film Co., Ltd., Kanagawa, Japan; Fuji Photo Film Co., Ltd., Kanagawa, Japan

[21] Appl. No.: 808,719

[22] Filed: Dec. 13, 1985

[30] Foreign Application Priority Data

Dec. 14, 1984 [JP] Japan ..... 59-264079

[51] Int. Cl.[4] ..... G03C 5/54; G03C 1/14; G03C 1/19; G03C 1/10

[52] U.S. Cl. ..... 430/203; 430/217; 430/583; 430/584; 430/585; 430/588; 430/591; 430/592

[58] Field of Search ..... 430/203, 217, 353, 560, 430/583-590, 593, 617, 619, 591, 592

[56] References Cited

U.S. PATENT DOCUMENTS

| | | | |
|---|---|---|---|
| 2,231,658 | 2/1941 | Brooker et al. | 430/588 |
| 2,688,545 | 9/1954 | Carroll et al. | 430/588 |
| 3,628,964 | 12/1971 | Shiba et al. | 430/588 |
| 3,694,217 | 9/1972 | Sakaguchi et al. | 430/588 |
| 4,022,617 | 5/1977 | McGuckin | 430/203 |
| 4,046,572 | 9/1977 | Hinata et al. | 430/584 |
| 4,124,387 | 11/1978 | Kohrt | 430/203 |
| 4,504,568 | 3/1985 | Clark et al. | 430/203 |
| 4,550,071 | 10/1985 | Aono et al. | 430/203 |
| 4,560,644 | 12/1985 | Naito et al. | 430/203 |
| 4,617,257 | 10/1986 | Sawada et al. | 430/617 |

*Primary Examiner*—Richard L. Schilling

*Attorney, Agent, or Firm*—Sughrue, Mion, Zinn, Macpeak & Seas; Sughrue, Mion, Zinn, Macpeak & Seas

[57] ABSTRACT

A process for forming an image is provided, comprising imagewise exposing a photosensitive material comprising on a support a photosensitive silver halide, a sensitizing dye having general formula (I) and/or (II), and a compound which forms or releases a mobile dye in proportion or counter-proportion to the reduction of the photosensitive silver halide into silver by heating, and transferring the resulting mobile dye to a dye-fixing element in the presence of a hydrophilic solvent, wherein formulas (I) and (II) are:

(I)

(II)

wherein $Z^1$ and $Z^2$ represent a group of non-metallic atoms necessary to form a 5- or 6-membered heterocyclic ring; $R^1$ and $R^2$ represent a substituted or unsubstituted alkyl group; $L^1$, $L^2$, and $L^3$ represent a substituted or unsubstituted methine group; p and q are equal to 0 or 1; m is equal to 0, 1, 2, or 3; $X1^{\ominus}$ represents an anion; k is equal to 0 or 1, with the proviso that the number of organic acid groups contained in the molecule except $X1^{\ominus}$ is up to 1, and $Z^3$ has the same meaning as $Z^1$ and $Z^2$; $R^3$ has the same meaning as $R^1$ and $R^2$ except an alkyl group having an acid group; $L^4$ and $L^5$ have the same meaning as $L^1$, $L^2$, and $L^3$; $Z^4$ represents a group of non-metallic atoms necessary to form a 5- or 6-membered heterocyclic ring; $R^4$ represents a hydrogen atom, or a substituted or unsubstituted alkyl, aryl or heterocyclic group; r has the same meaning as p and q; and n has the same meaning as m.

11 Claims, No Drawings

IMAGE FORMING PROCESS

BACKGROUND OF THE INVENTION

This invention relates to a process for forming an image comprising imagewise exposing a photosensitive material comprising a compound which reacts with a photosensitive silver halide upon heating to form or release a mobile dye, and transferring the resulting mobile dye to a dye-fixing element in the presence of a hydrophilic solvent.

A number of methods have been proposed for producing color images through heat development. Among others, U.S. Pat. Nos. 3,531,286; 3,761,270; and 4,021,240; Belgian Pat. No. 802,519; and *Research Disclosure,* September 1975, pages 31–32, disclose a process for forming a color image through coupling of an oxidant of a developing agent with a coupler, and a variety of developing agent used therein.

*Research Disclosure,* May 1978, pages 54–58, RD-16966 describes a process of forming an image by incorporating a nitrogen-containing heterocyclic group into a dye to form a silver salt and effecting heat development to release the dye.

A process for forming a positive color image by heat-sensitive silver dye bleaching process is also well known. Useful dye bleaching processes are disclosed in, for example, *Research Disclosure,* April 1976, pages 30–32, RD-14433; ibid, December 1976, pages 14–15, RD-15227; and U.S. Pat. No. 4,235,957.

A process for forming a color image using a leuco dye is described in, for example, U.S. Pat. Nos. 3,985,565 and 4,022,617.

These color image forming processes, however, have the drawback that during an extended period of storage, discoloration of color images formed and coloration of white areas occur under the action of coexisting silver halide, silver complex, developing agent and the like. New color image forming processes by heat development which are substantially free of such drawbacks are described in Japanese Patent Application Kokai Nos. 57-179840, 57-186774, 57-198458, 57-207250, 58-58543, 58-79247, 58-116537, 58-149046, 59-48764, 59-65839, 59-71046, 59-87450, 59-88730, etc. These processes are designed such that a mobile dye is formed or released in proportion or counter-proportion to the reduction of photosensitive silver halide into silver by heat development, and the resultant mobile dye is transferred to a dye-fixing element.

For the spectral sensitization of silver halide with a sensitizing dye in these processes, cyanine and merocyanine dyes are believed advantageous because of their high sensitivity. Some of these dyes can contaminate an image on the dye-fixing element, particularly white areas thereof. There is a continuing need for improvement in this respect.

SUMMARY OF THE INVENTION

It is, therefore, an object of the present invention to provide a novel and improved process for forming an image comprising imagewise exposing a photosensitive material comprising a compound which reacts with a photosensitive silver halide upon heating to form or release a mobile dye, and transferring the resulting mobile dye to a dye-fixing element in the presence of a hydrophilic solvent, wherein the staining of the resulting image on the dye-fixing element, particularly white areas thereof is prevented without sacrificing sensitivity.

According to the present invention, there is provided a process for forming an image, comprising imagewise exposing a photosensitive material comprising on a support a photosensitive silver halide, a sensitizing dye having general formula (I) and/or (II) as defined below, and a compound which forms or releases a mobile dye in proportion or counter-proportion to the reduction of the photosensitive silver halide into silver by heating, and transferring the resulting mobile dye to a dye-fixing element in the presence of a hydrophilic solvent, wherein formula (I) is:

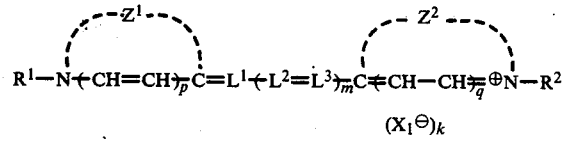

wherein $Z^1$ and $Z^2$ individually represent a group of non-metallic atoms necessary to form a 5- or 6-membered heterocyclic ring, $Z^1$ and $Z^2$ may be the same or different, $R^1$ and $R^2$ individually represent a substituted or unsubstituted alkyl group, $R^1$ and $R^2$ may be the same or different, $L^1$, $L^2$, and $L^3$ individually represent a substituted or unsubstituted methine group, p and q are individually equal to 0 or 1, m is equal to 0, 1, 2, or 3, $X1^{\ominus}$ represents an anion, k is equal to 0 or 1, with the proviso that the number of organic acid groups contained in the molecule except $X1^{\ominus}$ is up to 1, and formula (II) is:

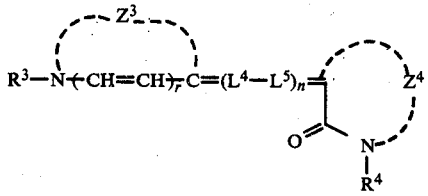

wherein $Z^3$ has the same meaning as $Z^1$ and $Z^2$, $R^3$ has the same meaning as $R^1$ and $R^2$ except an alkyl group having an acid group, $L^4$ and $L^5$ have the same meaning as $L^1$, $L^2$, and $L^3$, $Z^4$ represents a group of non-metallic atoms necessary to form a 5- or 6-membered heterocyclic ring, $R^4$ represents a hydrogen atom, or a substituted or unsubstituted alkyl, aryl or heterocyclic group, r has the same meaning as p and q, and n has the same meaning as m.

DETAILED DESCRIPTION OF THE INVENTION

The photosensitive material used in the image forming process of the present invention contains a sensitizing dye having the general formula (I) and/or (II) as illustrated below.

General formula (I):

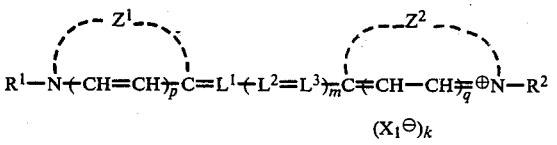

In formula (I), $Z^1$ and $Z^2$ individually represent a group of non-metallic atoms necessary to form a 5- or 6-membered heterocyclic ring. Illustrative, but non-limiting examples of the 5- and 6-membered heterocyclic rings include:

thiazole nuclei such as thiazole, 4-methylthiazole, 4-phenylthiazole, 4,5-dimethylthiazole, 4,5-diphenylthiazole, etc.;

benzothiazole nuclei such as benzothiazole, 4-chlorobenzothiazole, 5-chlorobenzothiazole, 5-nitrobenzothiazole, 6-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-phenethylbenzothiazole, 5-fluorobenzothiazole, 5-chloro-6-methylbenzothiazole, 5,6-dimethylbenzothiazole, 5-hydroxy-6-methylbenzothiazole, tetrahydrobenzothiazole, 4-phenylbenzothiazole, etc.;

naphthothiazole nuclei such as naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole, etc.;

thiazoline nuclei such as thiazoline, 4-methylthiazoline, 4-nitrothiazoline, etc.;

oxazole nuclei such as oxazole, 4-methyloxazole, 4-nitrooxazole, 5-methyloxazole, 4-phenyloxazole, 4,5-diphenyloxazole, 4-ethyloxazole, etc.;

benzoxazole nuclei such as benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole, etc.;

naphthoxazole nuclei such as naphth[2,1-d]oxazole, naphth[1,2-d]oxazole, naphth[2,3-d]oxazole, 5-nitronaphth[2,1-d]oxazole, etc.;

oxazoline nucei such as 4,4-dimethyloxazoline, etc.;

selenazole nuclei such as 4-methylselenazole, 4-nitroselenazole, 4-phenylselenazole, etc.;

benzoselenazole nuclei such as benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, etc.;

naphthoselenazole nuclei such as naphtho[2,1-d]selenazole, naphtho[1,2-d]selenazole, etc.;

3,3-dialkylindolenine nuclei such as 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, 3,3-dimethyl-5-chloroindolenine, etc.;

imidazole nuclei such as 1-alkylimidazoles, 1-alkyl-4-phenylimidazoles, 1-alkylbenzimidazoles, 1-alkyl-5-chlorobenzimidazoles, 1-alkyl-5,6-dichlorobenzimidazoles, 1-alkyl-5-methoxybenzimidazoles, 1-alkyl-5-cyanobenzimidazoles, 1-alkyl-5-fluorobenzimidazoles, 1-alkyl-5-trifluoromethylbenzimidazoles, 1-alkyl-6-chloro-5-cyanobenzimidazoles, 1-alkyl-6-chloro-5-trifluoromethylbenzimidazoles, 1-alkylnaphth[1,2-d]imidazoles, 1-allyl-5,6-dichlorobenzimidazole, 1-allyl-5-chlorobenzimidazole, 1-arylimidazoles, 1-arylbenzimidazoles, 1-aryl-5-chlorobenzimidazoles, 1-aryl-5,6-dichlorobenzimidazoles, 1-aryl-5-methoxybenzoimidazoles, 1-aryl-5-cyanobenzimidazoles, 1-arylnaphth[1,2-d]imidazoles, wherein the alkyl groups are preferably those having 1 to 8 carbon atoms, for example, unsubstituted alkyl groups such as methyl, ethyl, propyl, isopropyl, and butyl groups, hydroxyalkyl groups such as 2-hydroxyalkyl and 3-hydroxypropyl groups, and most preferably methyl and ethyl groups; and the aryl groups are phenyl group, halo-substituted phenyl groups (such as chloro-substituted ones), alkyl-substituted phenyl groups (such as methyl-substituted ones), and alkoxy-substituted phenyl groups (such as methoxy-substituted ones);

pyridine nuclei such as 2-pyridine, 4-pyridine, 5-methyl-2-pyridine, 3-methyl-4-pyridine, etc.;

quinoline nuclei such as 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, isoquinoline, 6-nitro-1-isoquinoline, 3,4-dihydro-1-isoquinoline, 6-nitro-3-isoquinoline, etc.;

imidazo[4,5-b]quinoxaline nuclei such as 1,3-diethylimidazo[4,5-b]quinoxaline, 6-chloro-1,3-diallylimidazo[4,5-b]quinoxaline, etc.;

oxadiazole nuclei; thiadiazole nuclei;

tetrazole nuclei; and pyrimidine nuclei.

$Z^1$ and $Z^2$ may be the same or different.

Illustrative, but non-limiting examples of the groups represented by $R^1$ and $R^2$ include substituted and unsubstituted alkyl groups having 1 to 18 carbon atoms, preferably 1 to 7 carbon atoms, and most preferably 4 to 7 carbon atoms.

Examples of the unsubstituted alkyl groups include methyl, ethyl, propyl, isopropyl, butyl, isobutyl, hexyl, octyl, dodecyl, and octadecyl groups.

Examples of the substituted alkyl groups include aralkyl groups such as benzyl and 2-phenylethyl groups;

hydroxyalkyl groups such as 2-hydroxyethyl and 3-hydroxypropyl groups;

carboxyalkyl groups such as 2-carboxyethyl, 3-carboxypropyl, 4-carboxybutyl, and carboxymethyl groups;

alkoxyalkyl groups such as 2-methoxyethyl and 2-(2-methoxyethoxy)ethyl groups;

sulfoalkyl groups such as 2-sulfoethyl, 3-sulfopropyl, 3-sulfobutyl, 4-sulfobutyl, 2-[3-sulfopropoxy]ethyl, 2-hydroxy-3-sulfopropyl, and 3-sulfopropoxyethoxyethyl groups;

sulfatoalkyl groups such as 3-sulfatopropyl and 4-sulfatobutyl groups;

heterocyclic ring-substituted alkyl groups such as 2-(pyrrolidin-2-on-1-yl)ethyl and tetrahydrofurfuryl groups;

2-acetoxyethyl group, carbomethoxymethyl group, 2-methanesulfonylaminoethyl group, allyl group, and the like.

$R^1$ and $R^2$ may be the same or different.

$L^1$, $L^2$, and $L^3$ individually represent a substituted or unsubstituted methine group. Exemplary of the substituents of the substituted methine groups there may be given alkyl groups such as methyl and ethyl groups;
aryl groups such as a phenyl group;
aralkyl groups such as a benzyl group;
halogen atoms such as chlorine and bromine atoms;
alkoxy groups such as methoxy and ethoxy groups;
the substituents on methine chains may together form a 4- to 6-membered ring.

Letter m is equal to 0, 1, 2, or 3.

$X1^{\ominus}$ represents an anion.

The number of organic acid groups contained in the molecule except $X1^{\ominus}$ is up to 1, that is, 0 or 1.

General formula (II):

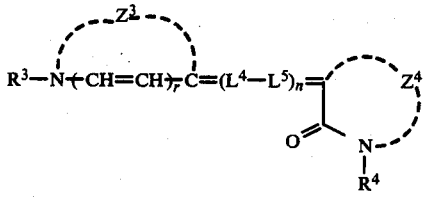

In formula (II), $Z^3$ has the same meaning as $Z^1$ and $Z^2$.

$R^3$ has the same meaning as $R^1$ and $R^2$ except an alkyl group having an acid group, such as sulfatoalkyl group.

$L^4$ and $L^5$ have the same meaning as $L^1$, $L^2$, and $L^3$.

$Z^4$ represents a group of non-metallic atoms necessary to form a 5- or 6-membered heterocyclic ring. Illustrative, but non-limiting examples of the 5- and 6-membered heterocyclic rings include a rhodanine nucleus, 2-thiohydantoin nucleus, 2-thioxoxazolidin-4-one nucleus, 2-pyrazolin-5-one nucleus, barbituric acid nucleus, 2-thiobarbituric acid nucleus, thiazolidin-2,4-dione nucleus, thiazolidin-4-one nucleus, isooxazolone nucleus, hydantoin nucleus, indanedione nucleus, etc.

$R^4$ is selected from the class consisting of a hydrogen atom;

unsubstituted alkyl groups having 1 to 18 carbon atoms, preferably 1 to 7 carbon atoms, and more preferably 4 to 7 carbon atoms, such as methyl, ethyl, propyl, isopropyl, butyl, isobutyl, hexyl, octyl, dodecyl, and octadecyl groups;

substituted alkyl groups having 1 to 20 carbon atoms, preferably 1 to 7 carbon atoms, and more preferably 4 to 7 carbon atoms, for example, an aralkyl group such as benzyl and 2-phenylethyl groups;

hydroxyalkyl groups such as 2-hydroxyethyl and 3-hydroxypropyl groups;

alkoxyalkyl groups such as 2-methoxyethyl and 2-(2-methoxyethoxy)ethyl groups;

heterocyclic ring-substituted alkyl groups such as 2-(pyrolidin-2-on-1-yl)ethyl, tetrahydrofurfuryl, 2-morpholinoethyl, 2-acetoxyethyl, carbomethoxymethyl, 2-methanesulfonylaminoethyl, and allyl groups;

unsubstituted aryl groups having 6 to 20 carbon atoms, preferably 6 to 14 carbon atoms, and more preferably 6 to 10 carbon atoms, such as phenyl and 2-naphthyl groups;

substituted aryl groups having 6 to 24 carbon atoms, preferably 6 to 16 carbon atoms, and more preferably 6 to 11 carbon atoms, such as 4-methoxyphenyl, 3-chlorophenyl, and 3-methylphenyl groups; and substituted and unsubstituted heterocyclic groups such as 2-pyridyl and 2-thiazolyl groups.

Letter r has the same meaning as p and q, and n has the same meaning as m.

Some illustrative, but non-limiting examples of the sensitizing dyes having general formulae (I) and (II) which can be advantageously be used in the practice of the invention are given below.

(1)

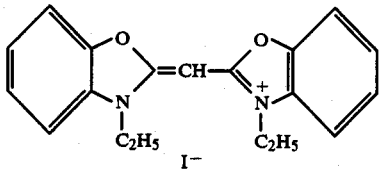

(2)

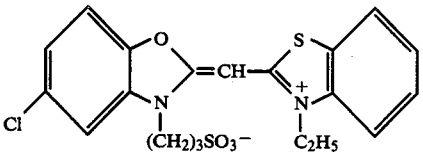

(3)

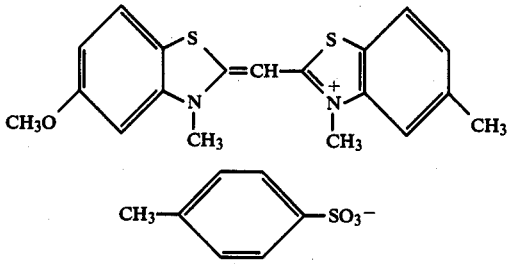

(4)

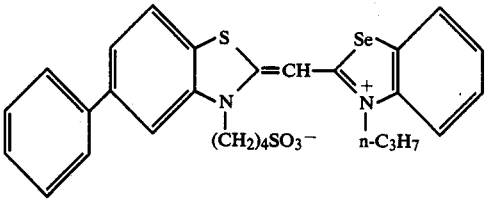

-continued
(5)
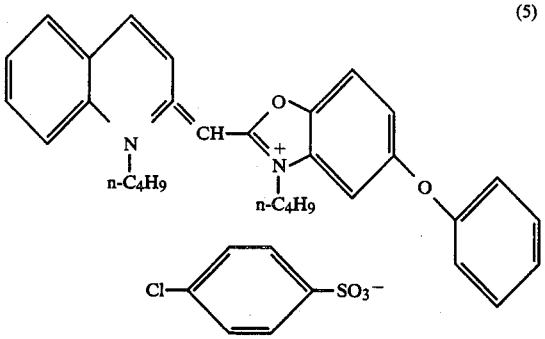
(6)
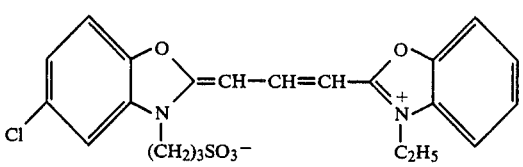
(7)
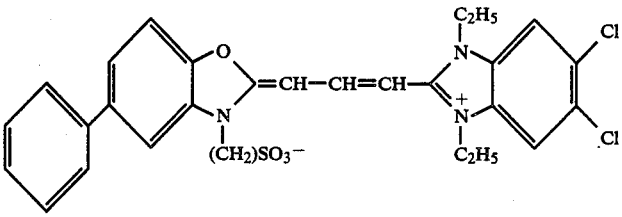
(8)
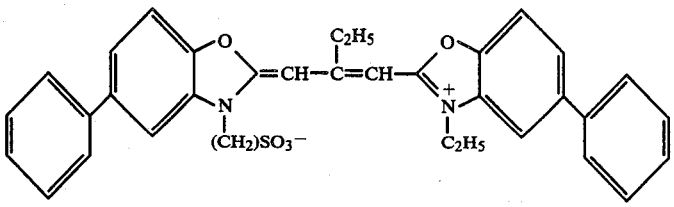
(9)
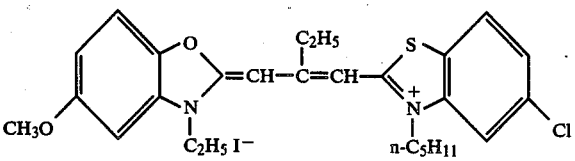
(10)
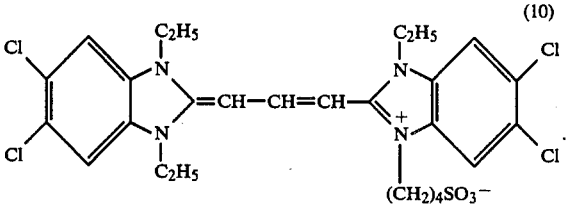
(11)
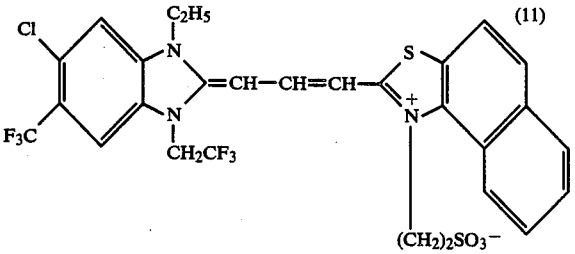
(12)
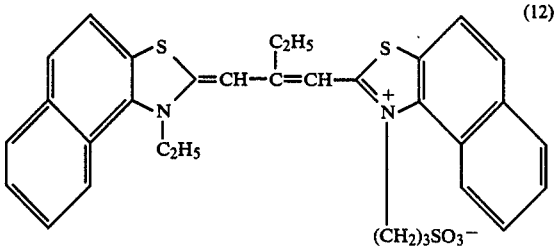
(13)
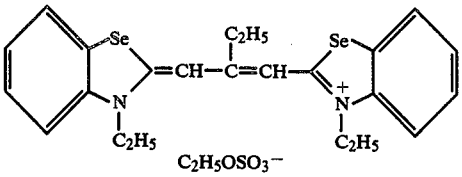
(14)
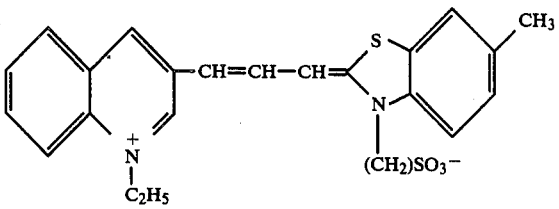

-continued
(15)
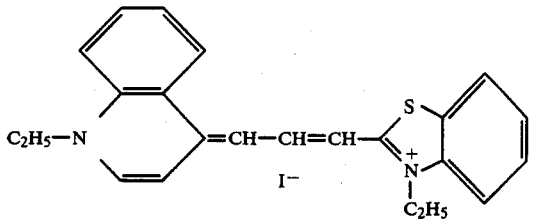
(16)
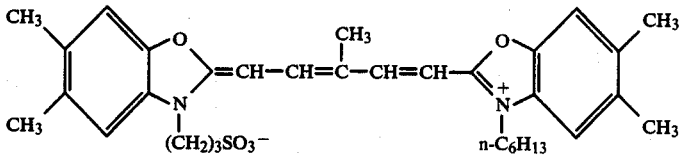
(17)
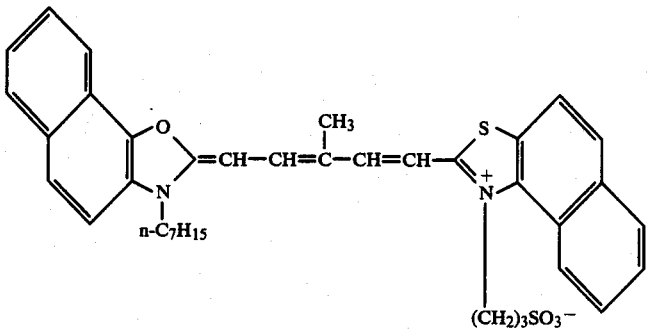
(18)
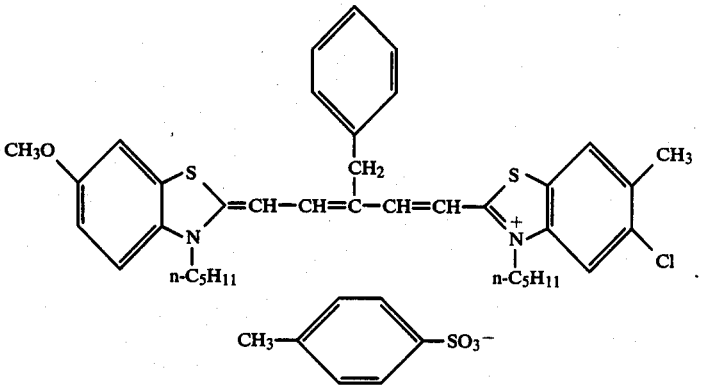
(19)
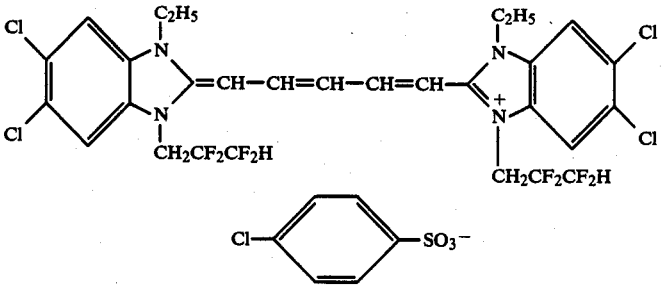
(20)
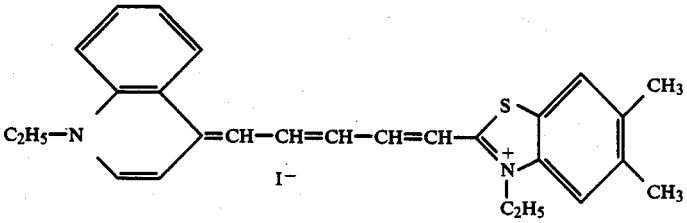

-continued
(21)
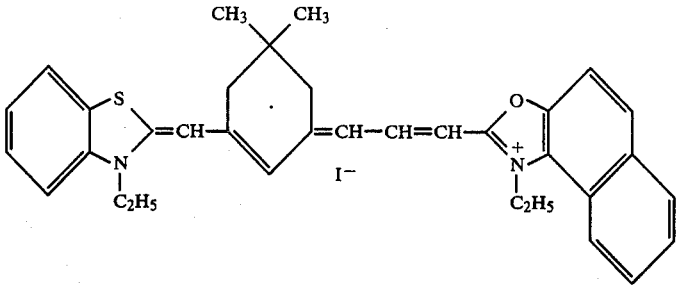
(22)
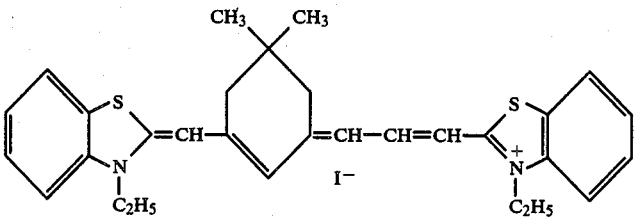
(23)
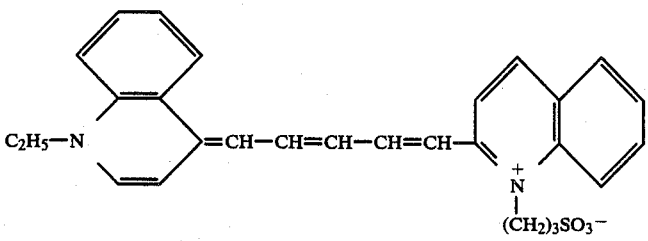
(24)
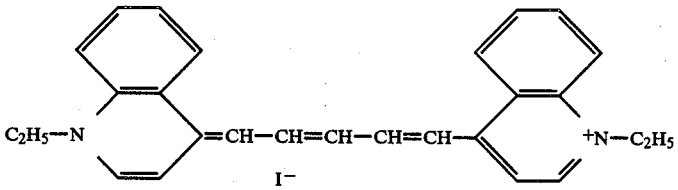
(25)
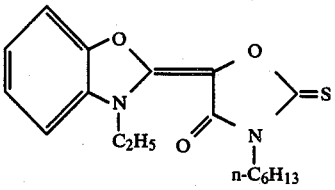
(26)
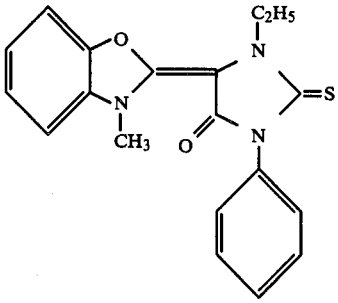
(27)
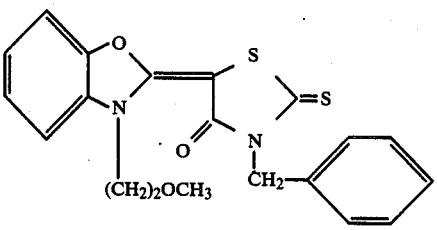
(28)
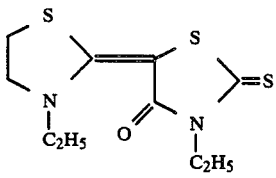

-continued
(29)
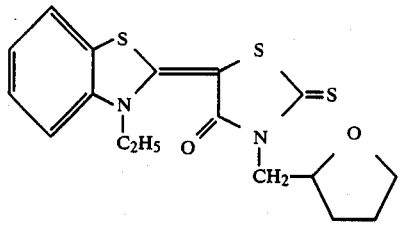
(30)
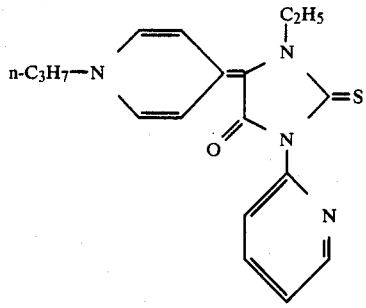
(31)
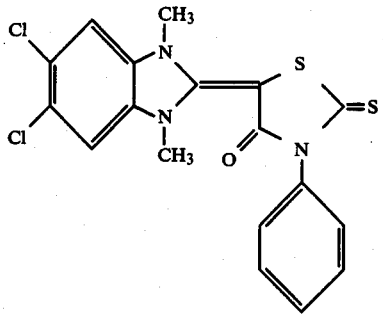
(32)
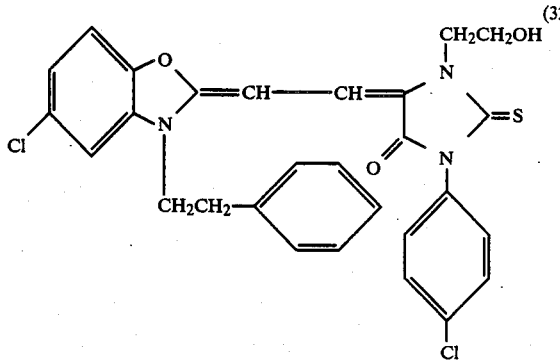
(33)
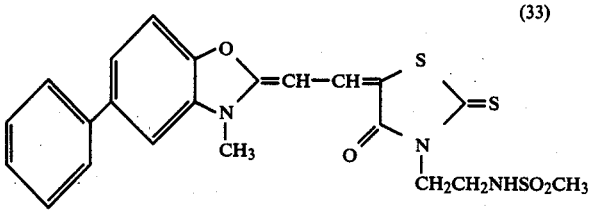
(34)
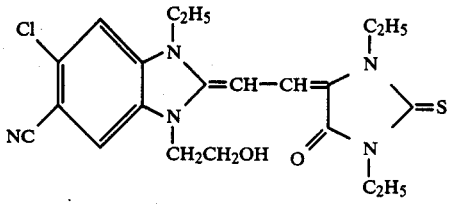
(35)
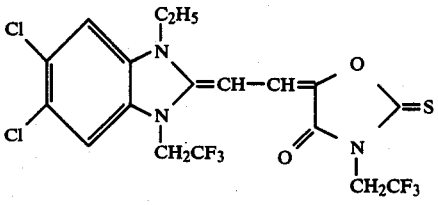
(36)
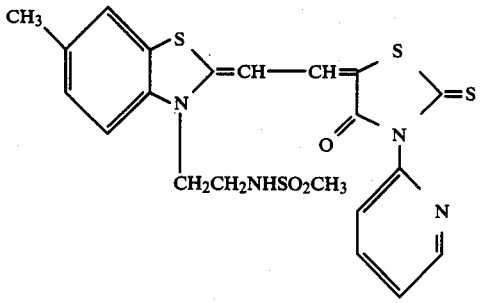
(37)
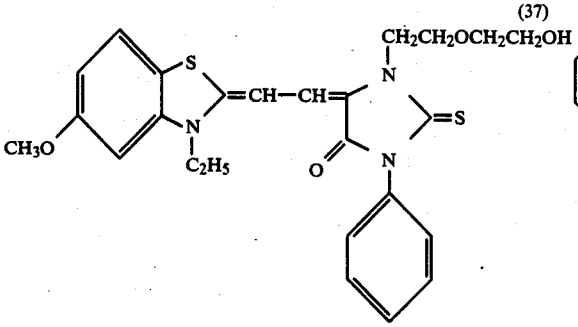
(38)
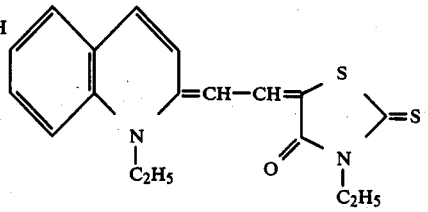

-continued
(39)
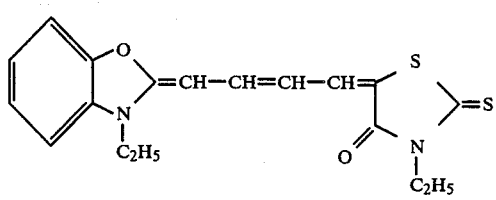
(40)
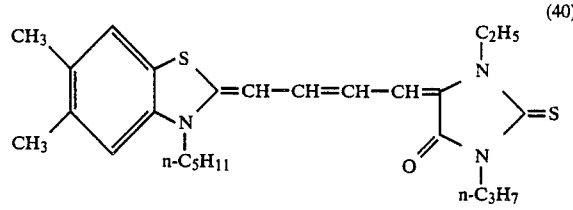
(41)
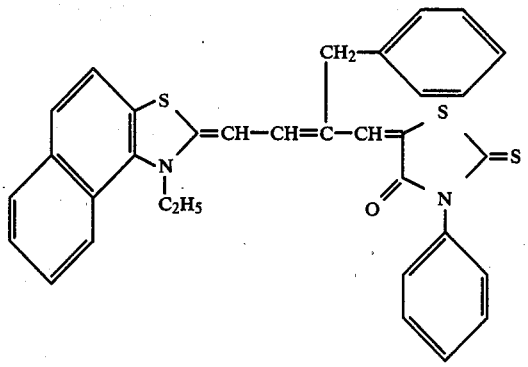
(42)
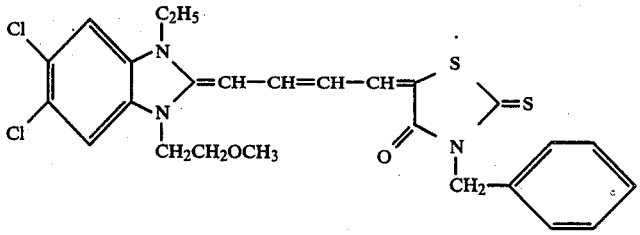
(43)
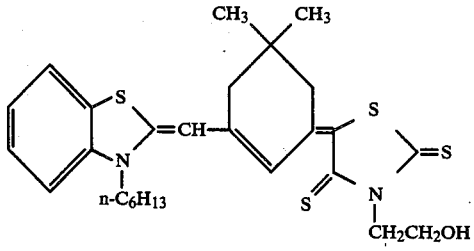
(44)
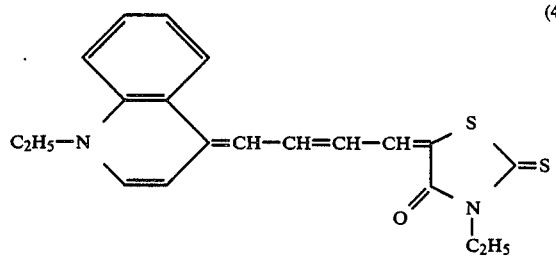
(45)
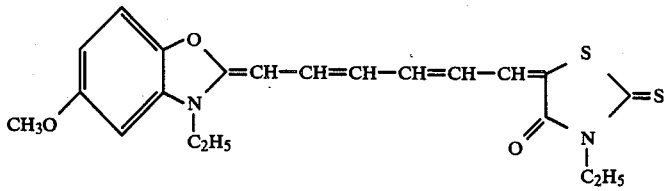
(46)
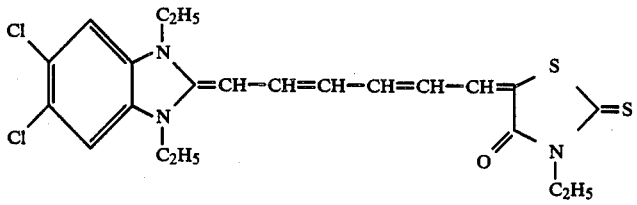

-continued

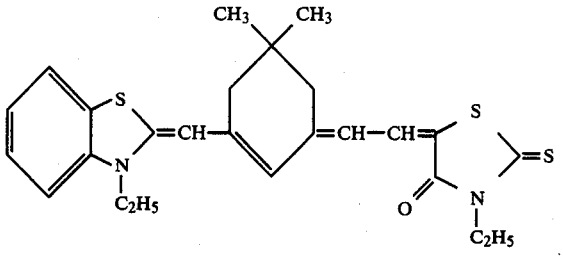

(47)

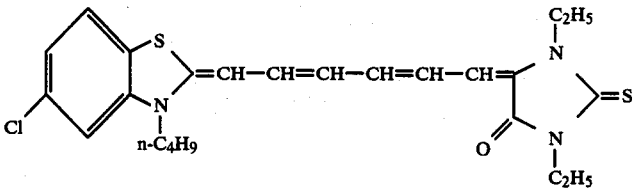

(48)

The sensitizing dyes having general formulas (I) and (II) used herein may be readily synthesized by any known methods as described in F. M. Hamer, "Heterocyclic compounds -Cyanine dyes and related compounds-", chapter V, pages 116–147, John Wiley & Sons, New York, London (1964), and D. M. Sturmer, "Heterocyclic Compounds -Special topics in heterocyclic chemistry-", chapter VIII, section IV, pages 482–515, John Wiley & Sons, New York, London (1977).

The sensitizing dyes may be used alone or in admixture.

The sensitizing dyes may be incorporated into a photographic silver halide emulsion either by directly dispersing the dyes into the emulsion or by dissolving the dyes in a suitable solvent such as water, methanol, ethanol, acetone, methyl cellosolve, etc. alone or in admixture and adding the resulting solution to the emulsion. Alternatively, the sensitizing dyes may be dissolved in a solvent substantially immiscible with water such as phenoxyethanol and then dispersed in water or hydrophilic colloid. The resulting dispersion is added to the emulsion. It is also possible to mix the sensitizing dyes with a lipophilic compound such as a dye-providing compound and add them to the emulsion at the same time. When more than one sensitizing dye is used, they may be dissolved in a solvent either separately or as a mixture. Also, they may be added to the emulsion either separately or as a mixture of them or with another additive. The sensitizing dyes may be added to the emulsion during or around chemical aging or around the nucleation of silver halide grains according to U.S. Pat. Nos. 4,183,756 and 4,225,666.

The sensitizing dyes are generally added in an amount of about $10^{-8}$ to $10^{-2}$ mols per mol of silver halide.

The photographic element according to the present invention comprises a photosensitive element which forms or releases a dye through heat development and optionally, a dye-fixing element which fixes the dye. Particularly systems of forming an image through diffusion transfer of a dye need the photosensitive and dye-fixing elements as requisite elements. They are generally classified into two typical forms, one form having photosensitive and dye-fixing elements separately applied on two separate supports and another form having both photosensitive and dye-fixing elements applied on a common support.

The former system having photosensitive and dye-fixing elements separately applied on two separate supports is preferable in the practice of the present invention, with such a system of peeling type being most preferred.

The former system having photosensitive and dye-fixing elements separately applied on two separate supports is generally sub-classified into two types, peeling type and non-peel type. In the case of peeling type, the coated surface of the photosensitive element is overlapped the coated surface of the dye-fixing element after imagewise exposure or heat development, and the photosensitive element is separated from the dye-fixing element immediately after formation of a transfer image. Depending on whether the final image is of reflective or transmissive type, the suport of the dye-fixing element may be selected among opaque or transparent supports. If desired, a white reflective layer may be applied. In the case of non-peel type, a white reflective layer must be interposed between the photosensitive layer of the photosensitive element and the dye-fixing layer of the dye-fixing element while the white reflective layer may be applied to either the photosensitive element or the dye-fixing element. The support of the dye-fixing element must be a transparent support.

The latter system having both photosensitive and dye-fixing elements applied on a common support is typically one wherein the photosensitive element need not be peeled from the image-receiving element after formation of a transfer image. In this case, a photosensitive layer, a dye-fixing layer, and a white reflective layer are laminated on a transparent or opaque support. The preferred arrangements are transparent or opaque support/photosensitive layer/white reflective layer/-dye-fixing layer and transparent support/dye-fixing layer/white reflective layer/photosensitive layer, to name a few.

Another typical form having both photosensitive and dye-fixing elements applied on a common support is one wherein a release layer is applied at a proper location such that the photosensitive element may be entirely or partially separated from the dye-fixing element, as disclosed in Japanese Patent Application Kokai No. 56-67840, Canadian Patent No. 674,082, and U.S. Pat. No. 3,730,718.

The photosensitive or dye-fixing element may be one possesing an electroconductive heating element layer as heating means for heat development or diffusion transfer of a dye.

In order to provide a wide range of color within the chromaticity diagram using three primary colors, yellow, magenta and cyan, the photosensitive element used in the practice of the invention should include at least three silver halide emulsion layers having sensitivity in different spectra.

Typical combinations of at least three silver halide emulsion layers having sensitivity in different spectra are a combination of blue-sensitive emulsion layer/green-sensitive emulsion layer/red-sensitive emulsion layer, a combination of green-sensitive emulsion layer/red-sensitive emulsion layer/infrared-sensitive emulsion layer, a combination of blue-sensitive emulsion layer/green-sensitive emulsion layer/infrared-sensitive emulsion layer, and a combination of blue-sensitive emulsion layer/red-sensitive emulsion layer/infrared-sensitive emulsion layer. By the infrared-sensitive emulsion layer used herein it is meant that the emulsion layer is sensitive to light having a wavelength of more than 700 nm, particularly more than 740 nm.

The photosensitive materials of the present invention may have two or more emulsion layers having sensitivity in the same spectrum, but different in emulsion sensitivity.

Each of the above-mentioned emulsion layers and/or photo-sensitive hydrophilic colloid layer disposed adjacent thereto should contain either of a dye-providing substance which releases or forms a hydrophilic yellow dye, a dye-providing substance which releases or forms a hydrophilic magenta dye, and a dye-providing substance which releases or forms a hydrophilic cyan dye. Differently stated, each emulsion layer and/or a photo-insensitive hydrophilic colloid layer disposed adjacent thereto should contain a dye-providing substance which releases or forms a hydrophilic dye of different hue. If desired, mixtures of two or more dye-providing substances having the same hue may be used. When the dye-providing substance is originally colored, the dye-providing substance may advantageously be contained in a layer other than this emulsion layer. In addition to the above-mentioned layers, the photosensitive materials of the present invention may further include any auxiliary layer, for example, a protective layer, intermediate layer, antistatic layer, anti-curling layer, release layer, and matte agent layer.

More specifically, the protective layer or coat (PC) usually contains an organic or inorganic matte agent for adherence prevention. The protective layer may further contain a mordant, a UV-absorber, etc. Each of the protective and intermediate layers may be comprised of two or more layers.

The intermediate layer may contain a reducing agent, a UV absorber, and a white pigment such as $TiO_2$ in order to prevent color mixing. The white pigment may be added not only to the intermediate layer, but also to the emulsion layers for the purpose of increasing sensitivity.

The dye-fixing element used in the present invention has at least one layer containing a mordant. When the dye-fixing layer is positioned at the surface, a protective layer may further be applied thereon if necessary.

Further, in order that a dye transfer assistant may be contained in a sufficient amount or controlled, a water-absorbing layer or dye transfer assistant-containing layer may be provided. Such a layer may be applied contiguous to the dye-fixing layer or via an intermediate layer.

The dye-fixing layer used in the practice of the invention may be divided into two layers containing mordants having different mordanting power, if necessary.

The dye-fixing element used in the practice of the invention may include any auxiliary layer, for example, a release layer, matte agent layer, and anti-curling layer.

One or more of the above-mentioned layers may contain a base or base precursor for promoting dye transfer, hydrophilic thermal solvent, anti-discoloration agent for preventing discoloration of dyes, UV absorber, dispersed vinyl compound for increasing dimensional stability, and brightening agent.

The binders used in the above-mentioned layers are preferably hydrophilic, and typically gelatin and polyvinyl alcohol.

The dye-fixing element may further include in addition to the above-mentioned layers, a reflective layer containing a white pigment like titanium oxide, neutralizing layer, neutralization timing layer or the like depending on the intended application. These layers may also be provided in the photosensitive element as well as in the dye-fixing element. The organization of these reflective, neutralizing, and neutralization timing layers is described, among others, in U.S. Pat. Nos. 2,983,606; 3,362,819; 3,362,821; and 3,415,644; and Canadian Pat. No. 928,559.

The dye-fixing element advantageously takes the form containing a transfer assistant as will be described later. The transfer assistant may be contained in either the dye-fixing layer or another layer.

The silver halides used in the present invention include silver chloride, silver chlorobromide, silver chloroiodide, silver bromide, silver iodobromide, silver chloroiodobromide, and silver iodide, but not limited thereto. The silver halide grains may have a uniform halogen composition or a multiple structure varying in composition from the surface to the interior (see Japanese Patent Application Kokai Nos. 57-154232, 58-108533, 59-48755, and 59-52237; U.S. Pat. No. 4,433,048; and European Patent No. 100,984). Also useful are plate particles having a thickness of up to 0.5 μm, a diameter of at least 0.6 μm, and an average aspect ratio of at least 5 (see U.S. Pat. No. 4,414,310 and 4,435,499 and German Patent Application (OLS) No. 3,241,646A1) and monodispersed emulsion having approximately uniform grain size distribution (see Japanese Patent Application Kokai Nos. 57-178235, 58-100846, and 58-14829, International Publication 83/02338A1, European Pat. Nos. 64,412A3 and 83,377A1). More than one silver halide having different crystal habit, halogen composition, grain size, or grain size distribution may also be used in admixture. More than one monodispersed emulsion having different grain size may be mixed so as to regulate gradation.

The average grain size of the silver halide used in the present invention is preferably from 0.001 μm to 10 μm and more preferably from 0.001 μm to 5 μm. The silver halide emulsion may be prepared by any of acidic, neutral, and ammoniacal methods while the type of reaction of soluble silver salt with soluble halide may be a single-jet and/or double-jet method. Also employable are reverse-mixing where grains are formed in the presence of an excess of silver ions and the controlled double-jet method where a constant pAg is kept. In order to accelerate grain growth, the concentration, amount, and addition rate of silver salt and halide added may be increased (see Japanese Patent Application Kokai Nos. 55-142329 and 55-158124 and U.S. Pat. No. 3,650,757).

Silver halide grains of epitaxial junction type may also be used (see Japanese Patent Application Kokai No. 56-16124 and U.S. Pat. No. 4,094,684).

When a silver halide is used alone without combining an organic silver salt-oxidizing agent, the silver chloroiodide, iodobromide, and chloroiodobromide in which the X-ray pattern of silver iodide crystals is observable may preferably be used.

The process for preparing these silver halides is explained with reference to the preparation of silver iodobromide. That is, silver iodobromide is prepared by first adding silver nitrate solution to potassium bromide solution to form silver bromide particles and then adding potassium iodide to the mixture.

In preparing the silver halide grains useful in the practice of the present invention, any suitable solvent for the silver halide may be used, for example, ammonia, organic thioether derivatives as disclosed in Japanese Patent Publication No. 47-11386, and sulfur-containing compounds as disclosed in Japanese Patent Application Kokai No. 53-144319.

In the stage of grain forming or physical ripening, there may coexist such salts as cadmium, zinc, lead, and thallium salts.

For the purpose of improving high or low intensity reciprocity law failure, there may be employed water-soluble iridium salts such as iridium (III, IV) chlorides and ammonium hexachloroiridate, and water-soluble rhodium salts such as rhodium chloride.

The silver halide emulsions may be applied without post-ripening, but ordinarily after chemical sensitization. For chemical sensitization purpose, there may be used sulfur sensitization, reducing sensitization, noble metal sensitization and other processes which are well known in connection with the emulsions for photosensitive materials of the ordinary type, and combinations thereof. Such chemical sensitization may be carried out in the presence of a nitrogen-containing heterocyclic compound as disclosed in Japanese Patent Application Kokai Nos. 58-126526 and 58-215644.

The silver halide emulsions used in the practice of the present invention may be either of the surface latent image type wherein latent images are predominantly formed on the grain surface or of the internal latent image type wherein latent images are formed in the grain interior. Also employable is a direct reversal emulsion having an internal latent image type emulsion combined with a nucleating agent. The internal latent image type emulsions useful for this purpose are described in U.S. Pat. Nos. 2,592,250 and 3,761,276, Japanese Patent Publication No. 58-3534 and Japanese Patent Application Kokai No. 57-136641, and the like. The nucleating agents suitable for use in such combination are described in U.S. Pat. Nos. 3,227,552, 4,245,037, 4,255,511, 4,266,031, and 4,276,364, OLS No. 2,635,316, and the like.

The amount of the photosensitive silver halide coated preferably ranges from 1 mg/m$^2$ to 10 g/m$^2$ of silver.

In the practice of the present invention, an organic metal salt which is relatively stable to light may be used as an oxidizing agent in combination with the photosensitive silver halide. It is necessary that the photosensitive silver halide and the organic metal salt be in contact with or close to each other. Preferred among these organic metal salts are organic silver salts. The organic metal salt incorporated in the heat-developable photosensitive material in combination with the silver halide is believed to participate in redox reaction by the catalysis of a latent image of silver halide when the heat-developable photosensitive material is heated to a temperature of at least 80° C., preferably at least 100° C.

Exemplary of the organic compounds which can be used to form the above-mentioned organic silver salt oxidizing agents, there may be given aliphatic and aromatic carboxylic acids, thiocarbonyl-containing compounds having a mercapto group or alpha-hydrogen, imino-containing compounds, and the like.

Typical examples of the silver salts of aliphatic carboxylic acids include silver salts derived from behenic acid, stearic acid, oleic acid, lauric acid, capric acid, myristic acid, palmitic acid, maleic acid, fumaric acid, tartaric acid, furoic acid, linolic acid, linoleic acid, adipic acid, sebacic acid, succinic acid, acetic acid, butyric acid, and camphoric acid. Also employable are those silver salts derived from halogen or hydroxyl-substituted ones of these fatty acids and aliphatic carboxylic acids having a thioether group.

Typical examples of the silver salts of aromatic carboxylic acids and other carboxyl-containing compounds include silver salts derived from benzoic acid, 3,5-dihydroxybenzoic acid, o-, m- or p-methylbenzoic acid, 2,4-dichlorobenzoic acid, acetamidebenzoic acid, p-phenylbenzoic acid, gallic acid, tannic acid, phthalic acid, terephthalic acid, salicylic acid, phenylacetic acid, pyromellitic acid, and 3-carboxymethyl-4-methyl-4-thiazoline-2-thione. Typical examples of the silver salts of mercapto or thiocarbonyl-containing compounds include silver salts derived from 3-mercapto-4-phenyl-1,2,4-triazole, 2-mercaptobenzimidazole, 2-mercapto-5-aminothiadiazole, 2-mercaptobenzothiazole, S-C$_{(12-22)}$alkylthioglycolic acids, dithiocarboxylic acids such as dithioacetic acid, thioamides such as thiostearoamide, 5-carboxy-1-methyl-2-phenyl-4-thiopyridine, and mercapto compounds as disclosed in U.S. Pat. No. 4,123,274, for example, mercaptotriazine, 2-mercaptobenzoxazole, mercaptooxadiazole, and 3-amino-5-benzylthio-1,2,4-triazole.

Typical examples of the silver salts of imino-containing compounds include silver salts derived from benzotriazole and its derivatives as disclosed in Japanese Patent Publication Nos. 44-30270 and 45-18416, for example, benzotriazole, alkyl-substituted benzotriazoles such as methylbenzotriazole, halo-substituted benzotriazoles such as 5-chlorobenzotriazole, and carboimidebenzotriazoles such as butylcarboimidebenzotriazole; nitrobenzotriazoles as disclosed in Japanese Patent Application Kokai No. 58-118639; sulfobenzotriazoles as disclosed in Japanese Patent Application Kokai No. 58-118638; carboxybenzotriazole and its salt or hydroxybenzotriazole; 1,2,4-triazoles and 1H-tetrazoles as disclosed in U.S. Pat. No. 4,220,709; carbazoles, saccharin, imidazole and their derivatives.

Also usable in the practice of the present invention are those silver salts described in *Research Disclosure*, No. 17029 (June 1978), organic metal salts other than silver salts such as copper stearate, and the silver salts of alkyl-containing carboxylic acids disclosed in Japanese Patent Application No. 58-221535, such as phenylpropiolic acid.

These organic silver salts may be used in amounts of from 0.01 to 10 moles, preferably from 0.01 to 1 mole per mole of the photosensitive silver halide. The combined amount of the photosensitive silver halide and the organic silver salt coated suitably ranges from about 50 $mg/m^2$ to 10 $g/m^2$.

The photosensitive material of the present invention contains a compound which, when the photosensitive silver halide is reduced into silver by heating, releases a mobile or diffusible dye in direct or inverse proportion to the reaction. These compounds are simply referred to as dye-providing substances hereinafter.

Preferred dye-providing substances which can be emmployed in the present invention may be represented by the following formula (L I):

$$(\text{Dye-X})_n\text{—Y} \qquad \text{(L I)}$$

wherein Dye represents a dye group or a dye precursor group; X represents a simple bond or a connecting group; and Y represents a group which, in correspondence or counter-correspondence to photosensitive silver salt having a latent image distributed imagewise, produces a difference in diffusibility of the compound represented by $(\text{Dye-X})_n$—Y or releases Dye, the diffusibility of Dye released being different from that of the compound represented by $(\text{Dye-X})_n$—Y, and n represents an integer of 1 or 2, when n=2, the dye-X's may be the same or different.

Exemplary of the dye-providing substances having general formula (L I) there may be given dye developing reagents in the form of a hydroquinone-type developing reagent having a dye moiety attached thereto as disclosed in U.S. Pat. Nos. 3,134,764; 3,362,819; 3,597,200; 3,544,545 and 3,482,972. In addition, substances which releases a diffusible dye through intramolecular nucleophilic substitution reaction are disclosed in Japanese Patent Application Kokai No. 51-63618 and substances which releases a diffusible dye through intramolecular rewind reaction of an isooxazolone ring are disclosed in Japanese Patent Application Kokai No. 49-111628. The system to which these substances are applied is that a diffusible dye is released or diffused where no development has taken place. No dye is released or diffused where development has taken place.

Since development and release or diffusion of the dye concurrently occur in these systems, it is very difficult to obtain an image having a high S/N ratio. In order to overcome this drawback, another system is proposed wherein the dye-providing substance is previously modified into an oxidant form having no dye releasing ability so that the modified substance may coexist with a reducing agent or precursor thereof. After development, the reducing agent which remains non-oxidized acts on the modified substance to reduce it, thereby releasing the diffusible dye. Typical examples of the dye-providing substances usable in such a system are described in Japanese Patent Application Kokai Nos. 53-110827, 54-130927, 56-164342, and 53-35533.

Also known are substances which release a diffusible dye where development has occurred. The substances which release a diffusible dye through the reaction of an oxidation product of a developing reagent with a coupler having a diffusible dye as an eliminatable group are described in British Pat. No. 1,330,524; Japanese Pataent Publication No. 48-39165; U.S. Pat. No. 3,443,940 and the like, and the substances which produce a diffusible dye through the reaction of an oxidation product of a developing reagent with a coupler having an anti-diffusible group as an eliminatable group are described in U.S. Pat. No. 3,227,550 and the like.

The systems using these color developing agents has the serious problem that the resulting image can be contaminated with oxidation decomposition products of a developing agent. To overcome this problem, a dye-releasing compound which itself has a reducing ability without the need for a developing agent. Typical examples of these compounds are disclosed in the following patents and literature.

U.S. Pat. No. 3,443,939,
U.S. Pat. No. 3,725,062,
U.S. Pat. No. 3,728,113,
U.S. Pat. No. 3,928,312,
U.S. Pat. No. 4,053,312,
U.S. Pat. No. 4,055,428,
U.S. Pat. No. 4,336,322,
Japanese Patent Application Kokai No. 59-65839,
Japanese Patent Application Kokai No. 59-69839,
Japanese Patent Application Kokai No. 58-116537,
Japanese Patent Application Kokai No. 53-3819,
Japanese Patent Application Kokai No. 51-104343, and
Research Disclosure, No. 17465.

Any of the foregoing dye-providing sybstances may be used in the practice of the present invention.

The dye-providing substance which can be a reducing agent capable of releasing a diffusible dye useful in the present invention is preferably represented by the general formula (L II):

$$\text{IR—SO}_2\text{—D} \qquad \text{(L II)}$$

In formula (L II), IR is a reducing substrate of the type capable of cleavage in direct or inverse proportion to a light-sensitive silver halide having imagewise latent images to release a dye, forming a difference in mobility between the released dye and the dye-providing substance. D represents an image-forming dye (or precursor thereof) moiety having mobility and may include a linkage connecting a "pure" dye portion and the $SO_2$ group.

The reducing substrate IR in the dye-providing substance IR—$SO_2$—D is preferably one which exhibits an oxidation-reduction potential of up to 1.2 volts with respect to the saturated calomel electrode in polarographic half-wave potential measurement using acetonitrile as a solvent and sodium perchlorate as a supporting electrolyte.

Illustrative of the reducing substrate represented by IR are those groups described in Japanese Patent Application Kokai No. 59-84236, pages 17–37 and represented therein by general formulas (II)–(X), (Xa), (Xb), (XI), (XIa), (XIb), (XIc), and (XII).

Illustrative, preferred examples of IR are described in Japanese Patent Application Kokai No. 59-84236, pages 30–37.

Exemplary of the dye moiety represented by D there may be given those derived from azo dyes, azomethine dyes, anthraquinone dyes, naphthoquinone dyes, styryl dyes, nitro dyes, quinoline dyes, carbonyl dyes, phthalocyanine dyes, and other dyes. These dye moieties may also take the form having temporarily shortened wavelengths. Illustrative examples of the dye moieties released from the dye-providing substances are those described in the above-incorporated Japanese Patent Application Kokai No. 59-84236, pages 37–59.

Exemplary of the dye-providing substances which can be used in the practice of the invention there may be given those compounds described in the above-incorporated Japanese Patent Application Kokai No. 59-84236, pages 60–91, with the compounds identified therein as compounds Nos. (1)–(3), (10)–(13), (16')–(19), (28)–(30), (33), (35), (38)–(40), and (42)–(64) being favorable among others. Also useful are cyan dye-providing substances as will be illustrated hereinafter and the yellow dye-providing substance illustrated below.

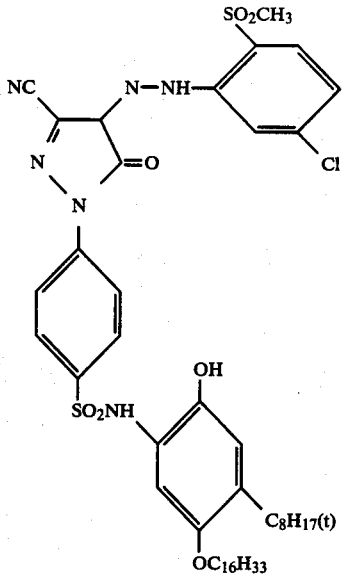

The dye-providing substance may be used at concentrations in a certain range. In general, the useful concentration ranges from about 0.01 to about 4 mols of dye-providing substance per mol of silver halide. The particularly useful concentraiton ranges from about 0.03 to about 1 mol per mol of silver halide.

The dye-releasing or providing substance used in the present invention can be introduced into a layer of the photosensitive material by such known methods as described in U.S. Pat. No. 2,322,027. In this case, either high-boiling or low-boiling solvents may be used.

A reducing agent may desirably be used in the light-sensitive material of the present invention. The reducing agents used herein include well-known reducing agents and the above-mentioned dye-providing substances having reducing ability. Also included are reducing agent precursors which themselves have no reducing ability, but exhibit reducing ability under the action of a nucleophilic agent or heat during the development process.

Examples of the reducing agents used herein include inorganic reducing agents such as sodium sulfite and sodium hydrogen sulfite, benzene sulfinic acids, hydroxylamines, hydrazines, hydrazides, borane-amine complexes, hydroquinones, aminophenols, catechols, p-phenylenediamines, 3-pyrazolidonones, hydroxytetronic acids, ascorbic acids, 4-amino-5-pyrazolones, etc. and the reducing agents described in T. H. James, "The Theory of the Photographic Process", the Fourth Edition, pages 291–334. Also usable are reducing agent precursors as disclosed in Japanese Patent Application Kokai Nos. 56-138736 and 57-40245, U.S. Pat. No. 4,330,617, and the like.

Various combinations of developing agents as described in U.S. Pat. No. 3,039,869 may also be used.

In the practice of the present invention, the reducing agent may be added in amounts of from 0.01 to 20 mols, preferably from 0.1 to 20 mols per mol of silver.

In the practice of the present invention, an image formation promotor may also be used. The image formation promotors have the functions of promoting such reactions as redox reaction of a silver salt-oxidizing agent with a reducing agent, formation of a dye from a dye-providing substance, decomposition of a dye or release of a mobile dye, and promoting transfer of a dye from a photosensitive material to a dye-fixing layer. From their physical-chemistry, they may be classified into bases, base precursors, nucleophilic compounds, oils, thermal solvents, surface-active agents, and compounds capable of interacting with silver or silver ion. It should be noted that these compounds generally have multiple functions and thus possess some of the above-mentioned promoting effects combined.

The image formation promotors are illustrated for each of functional classes. However, this classification is made for convenience of description and actually, one compound often possesses more than one function in combination.

(a) Bases

Preferred examples of the bases include (1) inorganic bases, for example, hydroxides, secondary and tertiary phosphates, borates, carbonates, quinolinates, and metaborates of alkali metals and alkaline earth metals; quaternary alkyl ammonium hydroxides; and other metal hydroxides; and (2) organic bases, for example, aliphatic amines such as trialkyl amines, hydroxylamines, and aliphatic polyamines; aromatic amines such as N-alkyl-substituted aromatic amines, N-hydroxylalkyl-substituted aromatic amines and bis[p-(dialkylamino)-phenyl]methanes; heterocyclic amines, amidines; cyclic amidines; guanidines; and cyclic guanidines. The particularly preferred bases are those having a pKa value of 8 or higher.

(b) Base precursors

Base precursors are preferably those precursors which undergo any reaction under heat to release a base, for example, organic acid-base salts which are decomposed or decarbonated upon heating, and compounds which are decomposed to release amines through such reactions as intramolecular nucleophilic substituting reaction, Lossen rearrangement, Beckman rearrangement, etc. The preferred base precursors include salts of trichloroacetic acid as described in U.K. Pat. No. 998,949; salts of alpha-sulfonylacetic acid as described in U.S. Pat. No. 4,060,420; salts of propiolic acid as described in Japanese Patent Application No. 58-55700; 2-carboxylcarboxamide derivatives as described in U.S. Pat. No. 4,088,496; salts of thermally decomposable acids with a basic component containing an organic base and an alkali metal or alkaline earth metal as described in Japanese Patent Application No. 58-69597; hydroxamcarbamates utilizing Lossen rearrangement as described in Japanese Patent Application No. 58-43860; and aldoximcarbamates capable of forming nitriles upon heating as described in Japanese Patent Application No. 58-31614. In addition, base precursors as disclosed in U.K. Pat. Nos. 998,945 and 2,079,480; U.S. Pat. No. 3,220,846; and Japanese Patent Application Kokai No. 50-22625, etc. are also useful.

(c) Nucleophilic compounds

Exemplary of the nucleophilic compounds there may be given water, water-releasing compounds, amines, amidines, guanidines, hydroxylamines, hydrazines, hydrazides, oximes, hydroxamic acid derivatives, sulfonamides, active methylene compounds, alcohols, and thiols, as well as salts and precursors of these compounds.

(d) Oils

Useful are those high-boiling organic solvents which are used as a solvent in emulsion dispersing a hydrophobic compound and also known as plasticizers.

(e) Thermal solvents

The thermal solvents are those compounds which are solid at an ambient temperature, but melts at approximately developing temperatures to serve as solvents. Useful are ureas, urethanes, amides, pyridines, sulfonamides, sulfones, sulfoxides, esters, ketones, and ethers, provided that they are solid at temperatures of lower than 40° C.

(f) Surface-active agents

Typical surface-active agents are pyridinium salts, ammonium salts, and phosphonium salts as disclosed in Japanese Patent Application Kokai No. 59-74547, and polyalkylene oxides as disclosed in Japanese Patent Application Kokai No. 59-57231.

(g) Compounds capable of interacting with silver or silver ion

Useful are imides, nitrogen-containing heterocyclic compounds as disclosed in Japanese Patent Application No. 58-51657, thiols as disclosed in Japanese Patent Application No. 57-222247, thioureas, and thioethers.

These image formation promotors may be incorporated in the photosensitive material and/or the dye-fixing material. The particular layer into which the image formation promotors are incorporated may be any of the emulsion layer, intermediate layer, protective layer, dye-fixing layer, and layers adjoining any of these layers. The same applies to an embodiment where both the photosensitive layer and the dye-fixing layer are on a common support.

The image formation promotors may be used alone or in admixture of two or more. Generally, the promoting effect is enhanced by the use of more than one promotor. An outstanding promoting effect is obtained particularly when the base or base precursor is combined with another promotor.

In the practice of the present invention, a variety of development inhibitors may be used for the purpose of obtaining a consistent image irrespective of variations in treating temperature and time during heat development. By the development inhibitor is meant those compounds capable of, immediately after development has proceeded to an optimum extent, neutralizing or reacting with a base to reduce its concentration in the film to inhibit development, or those compounds capable of, immediately after optimum development, interacting with silver or silver salt to retard development. Illustrative examples are acid precursors capable of releasing acid upon heating, electrophilic compounds capable of substitution reaction with a coexisting base upon heating, nitrogen-containing heterocyclic compounds, mercapto compounds, and the like. Specific examples of the acid precursors are oxime esters as disclosed in Japanese Patent Application Nos. 58-216928 and 59-48305, and those compounds capable of releasing an acid through Lossen rearrangement as disclosed in Japanese Patent Application No. 59-85834. Specific examples of the electrophilic compounds capable of substitution reaction with a base upon heating are such compounds as disclosed in Japanese Patent Application No. 59-85836, etc. The effect of these development inhibitors is enhanced particularly when they are combined with base precursors. The proportion of the base precursor to the acid precursor used herein may preferably range from 1/20 to 20/1, and more preferably, from 1/5 to 5/1 in molar ratio.

Further, in the present invention, it is possible to use a compound which activates development simultaneously with stabilizing the image. Particularly preferred compounds used herein are isothiuroniums including 2-hydroxyethylisothiuronium trichloroacetate as described in U.S. Pat. No. 3,301,678; bisisothiuroniums including 1,8-(3,6-dioxaoctane)-bis(isothiuronium trifluoroacetate) as described in U.S. Pat. No. 3,669,670; thiol compounds as described in German Patent Application (OLS) No. 2,162,714; thiazolium compounds such as 2-amino-2-thiazolium trichloroacetate, 2-amino-5-bromoethyl-2-thiazolium trichloroacetate, etc., as described in U.S. Pat. No. 4,012,260; compounds having alpha-sulfonylacetate as an acid part such as bis(2-amino-2-thiazolium)-methylenebis(sulfonylacetate), 2-amino-2-thiazolium phenylsulfonylacetate, etc., as described in U.S. Pat. No. 4,060,420.

Also preferred are azolthio ethers and blocked azolinthione compounds as described in Belgian Pat. No. 768,071; 4-aryl-1-carbamyl-2-tetrazoline-2-thione compounds as described in U.S. Pat. No. 3,893,859; and those compounds described in U.S. Pat. Nos. 3,839,041; 3,844,788; and 3,877,940.

The photosensitive materials of the present invention may contain a toning agent if desired. Useful toning agents are 1,2,4-triazoles, 1H-tetrazoles, thiouracils, 1,3,4-thiadiazoles, and similar compounds. Examples of the preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above generally ranges from about 0.001 to 0.1 mole per mole of silver in the photosensitive material although the exact content depends upon the type of a heat developable photosensitive material used, processing conditions, desired images and various other factors.

In the practice of the present invention, the binders may be employed alone or in combinations thereof. A hydrophilic binder may be used as the preferred binder according to the present invention. The typical hydrophilic binder is a transparent or translucent hydrophilic binder, examples of which include natural substances, for example, proteins such as gelatin, gelatin derivatives and cellulose derivatives and polysaccharides such as starch, gum arabic, etc.; and synthetic polymers, for example, water-soluble polyvinyl compounds such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

In the photographic photosensitive material and the dye-fixing material according to the present invention, the photographic emulsion layer and other binder layers may contain inorganic or organic hardeners.

The support used in the photosensitive material of the present invention and the optional dye-fixing material must withstand the processing temperature. Exemplary of ordinary supports there may be given not only glass, paper, metal and analogues, but also an acetyl cellulose film, a cellulose ester film, a polyvinyl acetal film, a polystyrene film, a polycarbonate film, a polyethylene terephthalate film, and a film or plastic material related thereto. Further, a paper support laminated with a polymer such as polyethylene, etc. may be used. Those polyesters described in U.S. Pat. Nos. 3,634,089 and 3,725,070 are preferably used.

When a dye-providing substance which releases a mobile dye imagewise is used in the practice of the present invention, a dye transfer assistant may be used to transfer the dye from the photosensitive layer to the dye-fixing layer.

The preferred dye transfer assistants include water and aqueous alkaline solutions containing inorganic alkali metal salts such as sodium hydroxide, potassium hydroxide, and sodium carbonate; monohydric alcohols such as methanol, ethanol, propanol, butanol, benzylalcohol, etc.; polyhydric alcohols such as ethylene glycol, diethylene glycol, polyethylene glycol, propylene glycol, glycerol, etc.; ethers having an alcoholic OH group such as furfuryl alcohol, methyl cellosolve, cellosolve, etc.; ketones such as acetone, acetyl acetone, methyl ethyl ketone, hexanone, cyclohexanone, etc.; esters such as methyl acetate, ethyl acetate, butyl acetate, methyl benzoate, n-butyl phosphate, etc.; nitrogen-containing solvents such as diethylamine, dibutylamine, pyridine, quinoline, etc.; and the like.

In the photosensitive material containing a hydrophilic dye to be transferred, when the dye transfer assistant is incorporated in the photosensitive material and/or dye-fixing material, it is preferably a hydrophilic thermal solvent. It is preferable to carry out transfer while heating the material in the presence of such a thermal solvent because the hydrophylic dye can be transferred and fixed to the dye-fixing element by heating.

In an image forming process of transferring the dye to the dye-fixing layer by heating in the presence of a hydrophilic thermal solvent, the transfer of the mobile dye may be started at the same time as release of the dye or after completion of such dye release. Therefore, heating for transfer may be effected either at the same time as or after heat development.

Since heating to effect dye transfer ranges from 60° to 250° C. in view of storage and operation of photosensitive materials, a choice may be made among those compounds which can act as a hydrophilic thermal solvent in this temperature range. Although the hydrophilic thermal solvent should, of course, promptly assist in the transfer of a dye when heated, it should have a melting point of 40° to 250° C., preferably 40° to 200° C., and more preferably 40° to 150° C. in consideration of the heat resistance of the photosensitive material.

The hydrophilic thermal solvent used herein is a compound which is solid at an ambient temperature and melted into liquid by heating, has an inorganic/organic nature value of more than 1, and has a degree of solubility of at least 1 in water at room temperature. The inorganic nature and organic nature are concepts for predicting the normalcy of a compound and their detail is described in Kagaku no Ryoiki (Chemical Region), 11, page 719(1957). The hydrophilic thermal solvent should have an inorganic/organic nature value of at least 1, preferably at least 2.

When molecular dimensions are taken into account, it is believed that there is preferably present around the migrating dye a molecule which can itself migrate without obstructing the migration of the dye. Then the hydrophilic thermal solvent preferably has a lower molecular weight, more preferably up to about 200, and most preferably up to about 100.

Since the hydrophilic thermal solvent is only required to substantially assist in the transfer of a hydrophilic dye generated as a result of heat development to the dye-fixing layer, it may be incorporated not only in the dye-fixing layer, but also in a photosensitive material in the photosensitive layer, or in both the dye-fixing and photosensitive layers. Alternatively, the hydrophilic thermal solvent may be incorporated by providing a separate layer containing it in the photosensitive material or in a separate dye-fixing material having a dye-fixing layer. In order to increase the efficiency of transfer of the dye into the dye-fixing layer, the hydrophilic thermal solvent is preferably contained in the dye-fixing layer and/or a layer adjacent thereto.

The hydrophilic thermal solvent is generally dissolved in water and dispersed in a binder although it may be used by dissolving in alcohols such as methanol and ethanol.

Exemplary of the hydrophilic thermal solvents there may be given ureas, pyridines, amides, sulfonamides, imides, alcohols, oximes and other heterocyclic compounds. Illustrative, preferred examples of the hydrophilic thermal solvents are those described in Japanese Patent Application Kokai No. 58-42092, pages 149–158.

The hydrophilic thermal solvents may be used alone or in combination of two or more.

The hydrophilic thermal solvents are used in the photosensitive or dye-fixing materials in an amount of 10 to 300% by weight, preferably 20 to 200% by weight, and more preferably 30 to 150% by weight based on the weight calculated from a total coated film thickness excluding the thermal solvent.

The dye transfer assistant may preferably used by wetting it with the solvent of the dye-fixing layer, or directly incorporated in the dye-fixing layer, or adsorbed in a polymer or crystal grains, or incorporated in the form of water of crystallization or microcapsules.

For the purpose of improving the sharpness of an image, filter dyes, absorptive materials and the like may be contained as disclosed in Japanese Patent Publication No. 48-3692; U.S. Pat. Nos. 3,253,921; 2,527,583; and 2,956,879; etc. Preferred among these dyes are thermally decoloring dyes, for example, those disclosed in U.S. Pat. Nos. 3,769,019; 3,745,009; and 3,615,432.

The photosensitive materials of the present invention may optionally contain any of a variety of additives well known for use in heat-developable photosensitive materials and possess in addition to the photosensitive layer, any layers including antistatic layer, electroconductive layer, protective layer, intermediate layer, AH layer, and release layer. Examples of the additives include such additives as disclosed in *Research Disclosure*, Vol. 170, July 1978, No. 17029, for example, plasticizers, sharpness improving dyes, AH dyes, sensitizing dyes, matte agents, surface-active agents, brightening agents, discloloration retarders, etc.

The dye-fixing element according to the present invention preferably has a dye-fixing layer which desirably contains a mordant. Polymeric mordants are particularly preferred among them. The polymeric mordants include polymers containing a tertiary amino group, polymers having a nitrogen-containing heterocyclic moiety, and polymers containing a quaternary cationic group.

The preferred mordants used in the practice of the invention are polymers containing vinyl monomer units having a tertiary amino group or quaternary ammonio group and represented by the following general formulas (L XI) through (L XIV).

General formula (L XI)

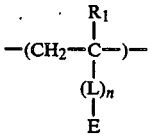

wherein $R_1$ represents a hydrogen atom or a lower alkyl group having 1 to 6 carbon atoms; L represents a divalent connecting group having 1 to 20 carbon atoms; E represents a heterocyclic ring containing as its component a nitrogen atom having a double bond with a carbon atom; and n is equal to 0 or 1.

General formula (LXII)

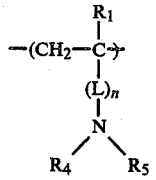

wherein $R_1$, L, and n are as defined for formula (L XI); $R_4$ and $R_5$ may be the same or different and are independently selected from alkyl groups having 1 to 12 carbon atoms and aralkyl groups having 7 to 20 carbon atoms, and $R_4$ and $R_5$ may be mutually combined to form a ring structure with the adjoining nitrogen atom;, and n is equal to 0 or 1.

General formula (LXIII)

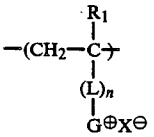

wherein $R_1$, L, and n are as defined for formula (L XI); $G^{\oplus}$ represents a heterocyclic ring containing as its component a quaternized nitrogen atom having a double bond with a carbon atom; and $X^{\ominus}$ represents a monovalent anion.

General formula (LXIV)

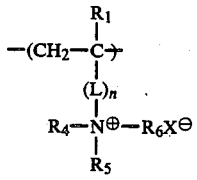

wherein $R_1$, L, and n are as defined for formula (L XI); $R_4$ and $R_5$ are as defined for formula (L XII); $R_6$ is selected from the same definition as made for $R_4$ and $R_5$; $X^{\ominus}$ is as defined for formula (L XIII); and $R_4$, $R_5$ and $R_6$ may be mutually combined to form a ring structure with the adjoining nitrogen atom.

In general formula (L XI), E represents a heterocyclic ring containing as its component a nitrogen atom having a double bond with a carbon atom as defined above. Examples of the heterocyclic rings represented by E include imidazole rings such as

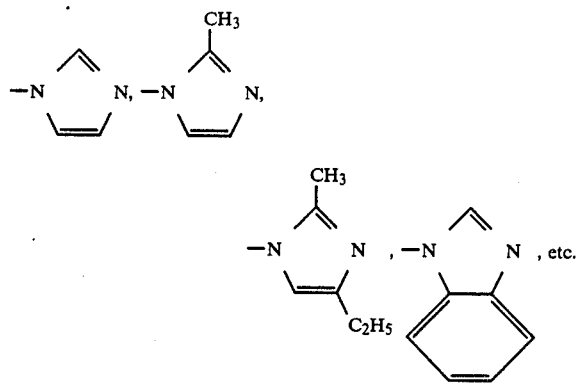

triazole rings such as

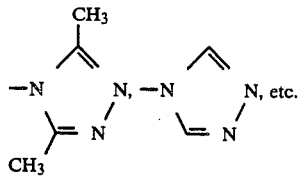

pyrazole rings such as

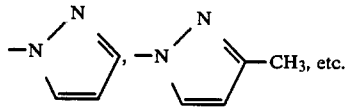

pyridine rings such as

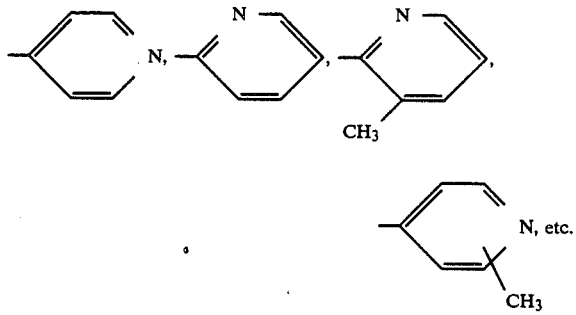

pyrimidine rings such as

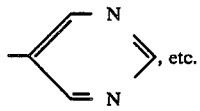

with the imidazole and pyridine rings being most preferred.

The polymers represented by general formula (L XI) and containing vinyl monomer units having a tertiary amino group are those mordants described in U.S. Pat. Nos. 4,282,305; 4,115,124; 3,148,061; etc. as well as those polymers described in Japanese Patent Application No. 59-209563, page 133–137.

The polymers represented by general formula (L XII) and containing vinyl monomer units having a tertiary amino group are those polymers described in Japanese Patent Application No. 59-209563, page 139–142.

The polymers represented by general formula (L XIII) and containing vinyl monomer units having a quaternary ammonium group are those mordants described in British Pat. No. 2,056,101,
British Pat. No. 2,093,041,
British Pat. No. 1,594,961,
U.S. Pat. No. 4,124,386,
U.S. Pat. No. 4,115,124,
U.S. Pat. No. 4,273,853,
U.S. Pat. No. 4,450,224, and
Japanese Patent Application Kokai No. 48-28225 as well as those polymers described in Japanese Patent Application No. 59-209563, page 146–152.

The polymers represented by general formula (L XIV) and containing vinyl monomer units having a quaternary ammonium group are those mordants described in U.S. Pat. Nos. 3,709,690; 3,898,088; 3,958,995, etc. as well as those polymers described in Japanese Patent Application No. 59-209563, page 154–156.

Other useful mordants include vinyl pyridine polymers and vinyl pyridinium cation polymers as disclosed in U.S. Pat. Nos. 2,548,564, 2,484,430, 3,148,061, 3,756,814, etc.; polymeric mordants crosslinkable with gelatin or the like as disclosed in U.S. Pat. Nos. 3,625,694, 3,859,096, and 4,128,538, British Pat. No. 1,277,453, etc.; aqueous sol mordants as disclosed in U.S. Pat. Nos. 3,958,995, 2,721,852, and 2,798,063, Japanese Patent Application Kokai Nos. 54-115228, 54-145529, and 54-126027, etc; water-insoluble mordants as disclosed in U.S. Pat. No. 3,898,088; reactive mordants capable of forming a covalent bond with a dye as disclosed in U.S. Pat. No. 4,168,976; as well as such mordants as disclosed in U.S. Pat. No. 3,709,690,
U.S. Pat. No. 3,788,855,
U.S. Pat. No. 3,642,482,
U.S. Pat. No. 3,488,706,
U.S. Pat. No. 3,557,066,
U.S. Pat. No. 3,271,147,
U.S. Pat. No. 3,271,148,
Japanese Patent Application Kokai No. 50-71332,
Japanese Patent Application Kokai No. 53-30328,
Japanese Patent Application Kokai No. 52-155528,
Japanese Patent Application Kokai No. 53-125, and
Japanese Patent Application Kokai No. 53-1024.

Also useful are the mordants described in U.S. Pat. Nos. 2,675,316 and 2,882,156.

Those skilled in the art will readily determine the particular mixing ratio of the polymeric mordant to gelatin and the amount of the polymeric mordant applied depending on the quantity of the dye to be mordated, the type and composition of the mordant used, and the image forming process applied. In general, the mordant/gelatin ratio ranges from 20/80 to 80/20 in weight ratio and the amount of the mordant coated ranges from 0.2 to 15 g/m$^2$, preferably from 0.5 to 8 g/m$^2$. The polymer used as the mordant should preferably have a molecular weight of 1,000 to 1,000,000, and more preferably 10,000 to 200,000.

When the above-mentioned polymer is used as the mordant, the transfer concentration of dye may be increased by introducing a metal ion into the photosensitive material or dye-fixing material. The metal ion may be added to a mordating layer containing the mordant or an upper or lower layer adjacent thereto. The metal ion used herein is desirably colorless and stable to heat and light. Specifically, polyvalent ions of transition metals such as $Cu^{2+}$, $Zn^{2+}$, $Ni^{2+}$, $Pt^{2+}$, $Pd^{2+}$, $Co^{3+}$ ions are preferred, with $Zn^{2+}$ being most preferred. The metal ion is generally added in the form of a water-soluble compound, for example, $ZnSO_4$ and $Zn(CH_3CO_2)_2$, and in an amount of 0.01 to 5 g/m$^2$, more preferably 0.1 to 1.5 g/m$^2$.

In general, the dye transfer assistant, for example, water is applied between a photosensitive layer of the heat-developable photosensitive material and a dye-fixing layer of the dye-fixing material to thereby accelerate the transfer of an image. The dye transfer assistant may be imparted to the photosensitive layer and/or the dye-fixing layer before they are overlaid one on another.

The dye transfer assistant may be incorporated into the photosensitive layer or dye-fixing layer by any well-known methods, for example, roller coating and wire bar applying methods as described in Japanese Patent Application Kokai No. 58-55907, application of water to the dye-fixing material using a water-absorbing member as described in Japanese Patent Application No. 58-55908, formation of a bead between the heat-developable photosensitive material and the dye-fixing material to impart a dye transfer assistant as described in Japanese Patent Application No. 58-55906, and formation of a bead between a water-repellent roller and the dye-fixing layer to impart a dye transfer assistant. Also applicable are dipping method, extrusion method, jet ejection through a fine port, pod-collapsing method, and many other known methods.

The dye transfer assistant may be added in a predetermined amount within a prescribed range as described in Japanese Patent Application No. 58-37902, or in an extra amount for subsequent adjustment such that an excess is subsequently squeezed out by applying a pressure by means of a roller or dried by heating. For example, a dye-fixing material is given a dye transfer assistant in an extra amount by any of the foregoing methods and then passed through compressing rollers to squeeze out the extra dye transfer assistant before it is overlaid on a heat-developable photosensitive material.

BENEFITS OF THE INVENTION

In a process for forming an image by imagewise exposing a photosensitive material comprising a compound which reacts with a photosensitive silver halide upon heating to form or release a mobile dye and transferring the resulting mobile dye to a dye-fixing element, the photosensitive material according to the present invention contains a sensitizing dye having general formula (I) and/or (II) as defined above. This provides an improved photographic process capable of forming an image on a dye-fixing element without substantial staining of the image, particularly white areas therein.

Particularly when the process involves a water transfer step, staining of an image-receiving sheet, particularly white areas therein is substantially prevented.

Useful sensitizing dyes are cyanine and merocyanine dyes because of high sensitivity. Among them, those of cation or betaine type as represented by formula (I) or (II) result in less staining or display more of the effect of the present invention rather than those of anion type.

EXAMPLES

In order that those skilled in the art may better understand how the present invention may be practiced, the following examples are given by way of illustration and not by way of limitation.

EXAMPLE 1

A silver benzotriazole emulsion was prepared as follows.

Preparation of Silver Benzotriazole Emulsion

Twenty eight (28) grams of gelatin and 13.2 grams of benzotriazole were dissolved in 3,000 ml of water. The resulting solution was agitated at 40° C. A solution of 17 grams silver nitrate in 100 ml water was added to the solution over a period of 2 minutes.

The resulting silver benzotriazole emulsion was adjusted to such pH that an excess salt precipitated, and the excess salt was filtered off. The emulsion was then adjusted to pH 6.30, obtaining a silver benzotriazole emulsion in a yield of 400 grams.

A silver halide emulsion (A) was prepared as follows.

Preparation of Silver Halide Emulsion (A)

An aqueous gelatin solution was prepared by dissolving 20 grams of gelatin and 3 grams of sodium chloride in 1000 ml of water and kept at a temperature of 75° C. While fully agitating the gelatin solution, 600 ml of an aqueous solution of sodium chloride and potassium bromide and another aqueous solution of 0.59 mols of silver nitrate in 600 ml of water were concurrently added to the gelatin solution at an equal flow rate over a period of 40 minutes. In this way, there was prepared a monodispersed cubic silver chlorobromide emulsion having an average grain size of 0.35 μm (bromine 80 mol%).

After rinsing with water and desalting, 5 mg of sodium thiosulfate and 20 mg of 4-hydroxy-6-methyl-1,3,3a,7-tetraazaindene were added to effect chemical sensitization at 60° C. There was obtained an emulsion in a yield of 600 grams.

Next, a dispersion of a dye-providing substance in gelatin was prepared as follows.

Preparation of Gelatin Dispersion of Dye-Providing Substance

Five (5) grams of cyan dye-providing material (A) having the formula shown below was dissolved together with 0.5 grams of succinic acid-2-ethylhexyl ester sodium sulfonate and 10 grams of triisononyl phosphate in 30 ml of ethyl acetate by heating at about 60° C., obtaining a homogeneous solution. The solution was mixed with 100 grams of a 10 wt% lime-treated gelatin solution by agitation, and the mixture was dispersed with a homogenizer for 10 minutes at 10,000 rpm. This dispersion is called cyan dye-providing substance dispersion.

Cyan dye-providing material (A)

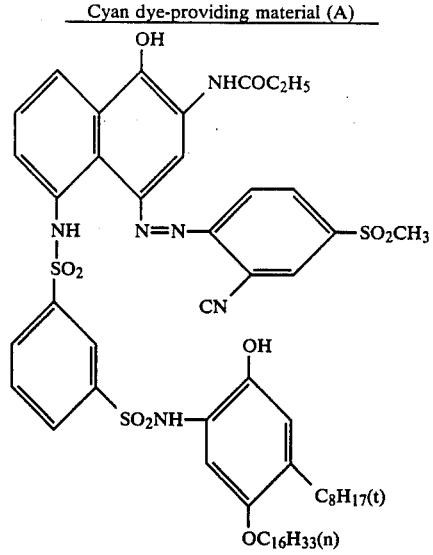

Preparation of Photosensitive Coating Composition

A photosensitive coating composition was prepared from the following formulation.

Photosensitive coating composition (a) Silver benzotriazole emulsion: 10 g
(b) Photosensitive silver chlorobromide emulsion (A): 15 g
(c) Dye-providing substance (A) dispersion: 25 g
(d) Aqueous solution of 5 wt% compound having the formula:

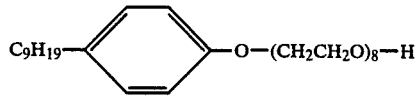

10 ml
(e) Methanol solution of 10% benzenesulfonamide: 5 ml
(f) Aqueous solution of 10 wt% guanidine 4-methylsulfonylphenyl sulfonyl acetate: 15 ml
(g) Methanol solution of 0.04% sensitizing dye (8): 6 ml Components (a) to (g) were mixed, and a thickening agent (for example, sodium polystyrene-p-sulfonate) and water were added to a total volume of 100 ml. This coating solution was applied to a polyethylene terephthalate base film of 180 μm thick to a wet thickness of 50 μm and then dried to form a photosensitive coating.

Further, a protective coating composition was prepared as follows.

Protective composition (h) 10% gelatin aqueous solution: 400 g
(i) Aqueous solution of 10 wt% guanidine 4-methylsulfonylphenyl sulfonyl acetate: 240 ml
(j) Aqueous solution of 4% hardener having the formula:

$CH_2{=}CH{-}SO_2CH_2CONH{-}(CH_2)_2{-}NHCOCH_2SO_2CH{=}CH_2$ 50 ml

Components (h) to (j) were mixed, and a thickening agent and water were added to a total volume of 1000 ml. The resulting protective composition was applied to the photosensitive coating to a wet thickness of 30 μm and then dried, obtaining photosensitive material No. 101.

Additional photosensitive materials as shown in Table 1 were prepared by the same procedure as for photosensitive material No. 101 except that sensitizing dyes shown in Table 1 were used in lieu of sensitizing dye (8) as component (g) in the preparation of photosensitive coating compositions.

Each sample of the photosensitive materials as prepared above was imagewise exposed for one second at 2000 lux under a tungsten lamp. Then the sample was uniformly heated for 30 seconds on a heat block at 140° C.

Next, the preparation of a dye-fixing material will be described.

Preparation of Dye-Fixing Material

Ten (10) grams of poly(methyl acrylate-co-N,N,N-trimethyl-N-vinylbenzylammonium chloride) having a molar ratio of methyl acrylate to vinylbenzyl ammonium chloride of 1:1 was dissolved in 200 ml of water, and the solution was homogeneously mixed with 100 grams of 10 wt% lime-treated gelatin. The resulting mixture was uniformly spread onto a paper substrate laminated with polyethylene having titanium dioxide dispersed therein, thereby forming a dye-fixing layer having a uniform wet thickness of 90 μm. The layer was dried to provide a dye-fixing material having a mordant layer.

Water was applied in an amount of 20 ml per square meter to the sensitive surface of the dye-fixing material prepared above. The heated photosensitive material was superimposed on the dye-fixing material such that their effective surfaces faced one another.

After heating on a heat block at 80° C. for 6 seconds, the dye-fixing material was peeled from the photosensitive material. The dye-fixing material then bore a cyan color image thereon. Density of the image was measured by means of a Macbeth (RD 519) reflection densitometer. The fogging ($D_R$) associated with the cyan dye-providing substance (A) was determined from the density measurement.

White area staining was determined by measuring the staining of an unexposed area or white area with the respective dyes by means of a Macbeth (RD 519) reflection densitometer using a B, G or R filter in accordance with the stained colors.

Relative sensitivity R.S. given by −log E wherein E is an exposure is expressed as a relative ratio provided that the relative sensitivity (−log E) of photosensitive material No. 101 is 1.0.

The results are shown in Table 1.

TABLE 1

| Photosensitive material | Sensitizing dye* | R.S. -log E | White area Staining | Fogging $D_R$ |
|---|---|---|---|---|
| 101 | (8) | 1.0 | 0.05 (DG) | 0.12 |
| 102 | (3) | 0.9 | 0.06 (DG) | 0.11 |
| 103 | (36) | 0.5 | 0.05 (DG) | 0.12 |
| 111 | a | 0.8 | 0.15 (DG) | 0.13 |
| 112 | b | 0.7 | 0.17 (DG) | 0.13 |

TABLE 1-continued

| Photosensitive material | Sensitizing dye* | R.S. -log E | White area Staining | Fogging $D_R$ |
|---|---|---|---|---|
| 113 | c | 0.5 | 0.20 (DG) | 0.12 |

*a

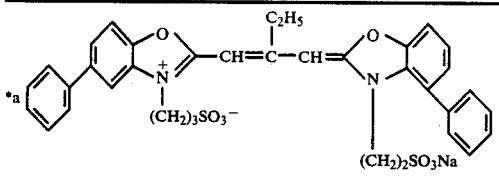

b

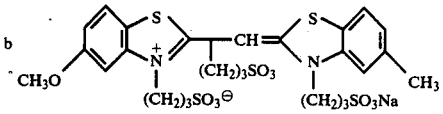

c

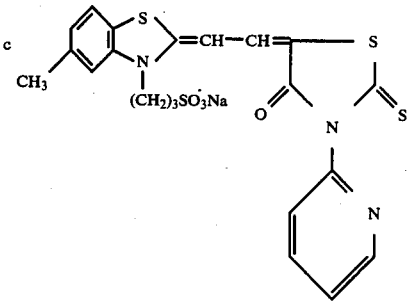

As evident from the data of Table 1, the photosensitive materials containing the sensitizing dyes defined in the present invention are significantly free of white area staining.

EXAMPLE 2

This example illustrate another example of dye-providing substance gelatin dispersion in which a magenta dye-providing substance (B) is used in lieu of the cyan dye-providing substance (A) used in Example 1.

A dispersion of dye-providing substance in gelatin was prepared by the same procedure as described in Example 1 except that magenta dye-providing substance (B) shown below was used and 7.5 grams of tricresyl phosphate was used as a high-boiling solvent.

Magenta dye-providing substance (B):

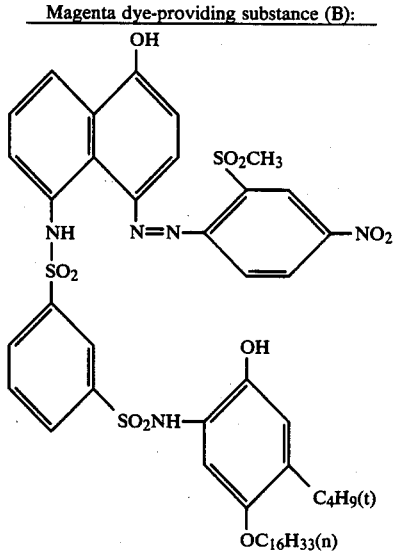

Using the resulting dye-providing substance dispersion, photosensitive materials were prepared by the same procedure as described in Example 1 except that the sensitive dyes shown in Table 2 were used, and then processed by the same procedure as described in Example 1 to determine the fogging ($D_G$), white area staining, and relative sensitivity (−log E) associated with the magenta dye-providing substance. These properties are as defined in Example 1.

The results are shown in Table 2.

TABLE 2

| Photosensitive material | Sensitizing dye* | R.S. −log E | White area Staining | Fogging $D_G$ |
|---|---|---|---|---|
| 201 | (2) | 1.1 | 0.07 (DB) | 0.15 |
| 202 | (12) | 2.0 | 0.05 (DR) | 0.17 |
| 203 | (41) | 1.5 | 0.06 (DR) | 0.16 |
| 204 | (47) | 1.8 | 0.07 (DR) | 0.16 |
| 211 | d | 1.1 | 0.21 (DB) | 0.16 |
| 212 | e | 1.9 | 0.13 (DR) | 0.17 |
| 213 | f | 1.3 | 0.18 (DR) | 0.16 |
| 214 | g | 1.5 | 0.25 (DR) | 0.17 |

*d

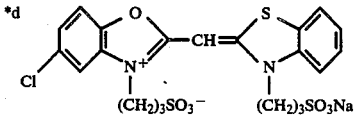

e

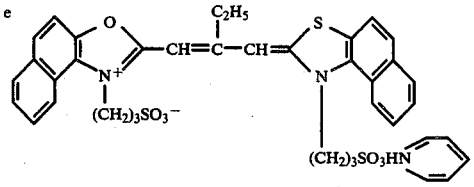

f

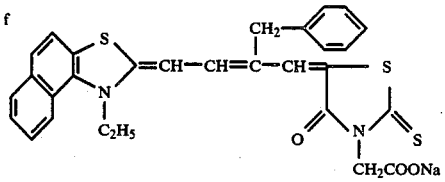

g

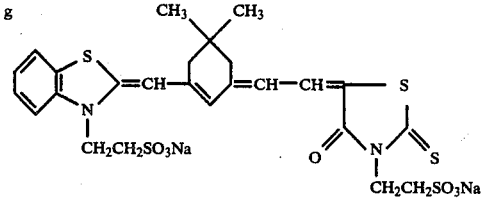

As evident from the data of Table 2, the photosensitive materials containing the sensitizing dyes defined in the present invention are significantly free of white area staining.

EXAMPLE 3

Silver halide emulsions (B) and (B') were prepared.

Preparation of Silver Halide Emulsion

An aqueous gelatin solution (solution I) was prepared by dissolving 24 grams of gelatin, 1 gram of potassium bromide, and 10 ml of 25% aqueous ammonia in 1 liter of water. The solution was agitated at 50° C.

A solution (solution a) of 100 grams silver nitrate in 1 liter water, a solution (soution b) of 63 grams potassium bromide and 12 grams potassium iodide in 1 liter water, and a solution (solution c) of 0.029 grams of sensitizing dye (10) of the invention in 300 ml methanol were concurrently added to solution I over a period of 50 minutes to produce a silver iodobromide emulsion (B).

Another emulsion (B') was prepared in the same manner as above for emulsion (B) except that sensitizing dye (10) of the invention was replaced by sensitizing dye (h) as shown below.

Sensitizing dye (h)

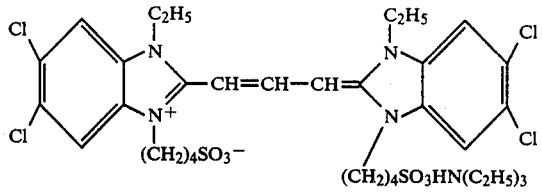

A dye-providing substance gelatin dispersion was prepared by the same procedure as in Example 1 except that yellow dye-providing substance (C) shown below was used Yellow dye-providing substance (C):

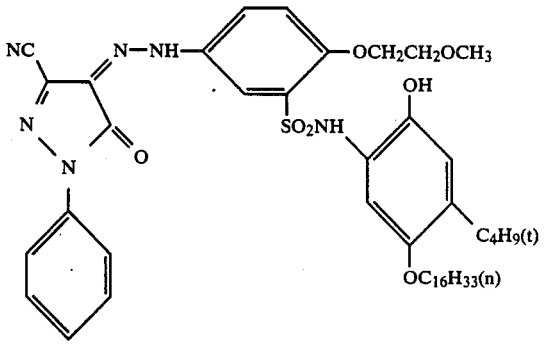

A photosensitive material was prepared by the same procedure as in Example 1 except that emulsion (A) used in Example 1 was replaced by emulsion (B) or (B') and the yellow dye-providing substance emulsion prepared above was used.

Photosensitive material Nos. 301 and 311 were prepared from emulsions (B) and (B'), respectively.

The photosensitive materials were processed in the same manner as in Example 1 to determine the fogging ($D_B$), white area staining, and relative sensitive R.S. (−log E) associated with the yellow dye-providing substance.

The results are shown in Table 3.

TABLE 3

| Photosensitive material | Sensitizing dye* | R.S. -log E | White area Staining | Fogging $D_B$ |
|---|---|---|---|---|
| 301 | (10) | 2.0 | 0.07 (DG) | 0.18 |
| 311 | h | 1.9 | 0.19 (DG) | 0.21 |

As evident from the data of Table 3, the photosensitive material containing the sensitizing dye defined in the present invention is significantly free of white area staining.

EXAMPLE 4

This invention illustrates a color photosensitive material of multilayer structure.

A support in the form of a polyethylene terephthalate film was coated with the following first (lowermost) to sixth (uppermost) layers to form a color photosensitive material of multilayer structure No. 401.

[FORMULATION]

Sixth layer gelatin (coating weight 1000 mg/m$^2$)
base precursor*3 (coating weight 600 mg/m$^2$)
hardener (coating weight 100 mg/m$^2$)
silica*5 (coating weight 100 mg/m$^2$)

Fifth layer: Green-sensitive emulsion layer
silver chlorobromide emulsion (bromine 50 mol%, coating weight 400 mg/m$^2$ of Ag)
benzenesulfonamide (coating weight 180 mg/m$^2$)
silver benzotriazole emulsion (coating weight 100 mg/m$^2$)
sensitizing dye (7) (coating weight $10^{-6}$ mol/m$^2$)
base precursor*3 (coating weight 500 mg/m$^2$)
yellow dye-providing substance (D) (coating weight 400 mg/m$^2$)
gelatin (coating weight 1000 mg/m$^2$)
high-boiling solvent*4 (coating weight 800 mg/m$^2$)
surface-active agent*2 (coating weight 100 mg/m$^2$)

Fourth layer: Intermediate layer
gelatin (coating weight 1200 mg/m$^2$)
base precursor*3 (coating weight 600 mg/m$^2$)

Third layer: Red-sensitive emulsion layer
silver chlorobromide emulsion (bromine 80 mol%, coating weight 300 mg/m$^2$ of Ag)
benzenesulfonamide (coating weight 180 mg/m$^2$)
silver benzotriazole emulsion (coating weight 100 mg/m$^2$ of Ag)
sensitizing dye (40) (coating weight $8\times10^{-7}$ mol/m$^2$)
base precursor*3 (coating weight 450 mg/m$^2$)
magenta dye-providing substance (E) (coating weight 400 mg/m$^2$)
gelatin (coating weight 1000 mg/m$^2$)
high-boiling solvent*1 (coating weight 600 mg/m$^2$)
surface-active agent*2 (coating weight 100 mg/m$^2$)

Second layer: Intermediate layer
gelatin (coating weight 1000 mg/m$^2$)
base precursor*3 (coating weight 600 mg/m$^2$)

First layer: Infrared-sensitive emulsion layer
silver chlorobromide emulsion (bromine 50 mol%, coating weight 300 mg/m$^2$ of Ag)
benzenesulfonamide (coating weight 180 mg/m$^2$)
silver benzotriazole emulsion (coating weight 100 mg/m$^2$ of Ag)
sensitizing dye (22) (coating weight $10^{-8}$ mol/m$^2$)
base precursor*3 (coating weight 500 mg/m$^2$)
cyan dye-providing substance (A) (coating weight 300 mg/m$^2$)
gelatin (coating weight 1000 mg/m$^2$)
high-boiling solvent*4 (coating weight 600 mg/m$^2$)
surface-active agent*2 (coating weight 100 mg/m$^2$)

Support

*1 tricresyl phosphate

*2 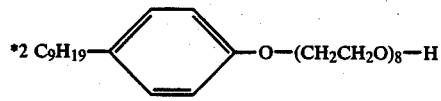

*3 guanidine 4-methylsulfonyl-phenylsulfonyl acetate
*4 (iso-$C_9H_{19}O)_3P{=}O$
*5 size 4 μm
6 1,2-bis(vinylsulfonylacetoamide)ethane The preparation of emulsions for the fifth and third layers will be illustrated in detail.

The fifth layer silver halide emulsion was prepared by dissolving 20 grams of gelatin and 3 grams of sodium chloride in 1000 ml of water to form an aqueous gelatin solution. To the fully agitated gelating solution kept at a temperature of 75° C., 600 ml of an aqueous solution of sodium chloride and potassium bromide and another aqueous solution of 0.59 mols silver nitrate in 600 ml water were concurrently added at an equal flow rate over a period of 40 minutes. In this way, there was prepared a monodispersed cubic silver chlorobromide emulsion having an average grain size of 0.40 μm (bromine 50 mol%).

After rinsing with water and desalting, 5 mg of sodium thiosulfate and 20 mg of 4-hydroxy-6-methyl-1,3,3a,7-tetraazaindene were added to effect chemical sensitization at 60° C. There was obtained an emulsion in a yield of 600 grams.

The third layer silver halide emulsion was prepared by the same procedure as the silver halide emulsion (A) in Example 1. The silver benzotriazole emulsion was also prepared by the same procedure as in Example 1.

Dispersions of dye-providing substances in gelatin were prepared as follows.

A homogeneous solution was prepared by weighing and mixing 5 grams of yellow dye-providing substance (D) shown below, 0.5 grams of succinic acid-2-ethylhexyl ester sodium sulfonate as a surface-active agent, and 10 grams of triisononyl phosphate, adding 30 ml of ethyl acetate to the mixture, and heating the mixture to about 60° C. for dissolution. The solution was mixed with 100 grams of 10% lime-treated gelatin solution by agitation, and the mixture was then fully dispersed for 10 minutes in a homogenizer at 10,000 rpm. The resulting dispersion is designated a yellow dye-providing substance dispersion.

A magenta dye-providing substance dispersion was prepared in the same manner as above except that magenta dye-providing substance (E) shown below was used and 7.5 grams of tricresyl phosphate was used as a high-boiling solvent.

A cyan dye-providing substance dispersion was prepared in the same manner as above except that cyan dye-providing substance (A) used in Example 1 was used.

Each sample of the color photosensitive materials of multilayer structure was exposed for one second at 5000 lux under a tungsten lamp through three color separation filters G, R, and IR having a continuously varying density. It should be noted that filter G is a 500–600 nm band pass filter, filter R is a 600–700 nm band pass filter, and filter IR is a filter transmitting light have wavelengths of at least 700 nm.

The sample was then uniformly heated for 30 seconds on a heat block at 140° C.

Water was applied in an amount of 20 ml per square meter to the sensitive surface of a dye-fixing material prepared in the samme manner as in Example 1. The heated photosensitive material was superimposed on the dye-fixing material such that their sensitive surfaces faced one another.

After heating on a heat block at 80° C. for 6 seconds, the dye-fixing material was peeled from the photosensitive material. The dye-fixing material then bore thereon color images of yellow, magenta, and cyan corresponding to the G, R, and IR three color separation filters. The maximum density (Dmax) and minimum density (Dmin) of the respective color images were measured by means of a Macbeth (RD 519) reflection densitometer.

The results are shown in Table 4.

TABLE 4

| 3-color separation filter | color image | Dmax | Dmin | γ | White area Staining |
|---|---|---|---|---|---|
| G | yellow | 2.00 | 0.14 | 2.2 | 0.06 (DG) |
| R | magenta | 2.35 | 0.13 | 2.4 | 0.07 (DR) |
| IR | cyan | 2.50 | 0.15 | 2.5 | 0.15 (DR) |

As evident from the data of Table 4, the photosensitive material containing the sensitizing dye defined in the present invention is significantly free of white area staining.

(D)

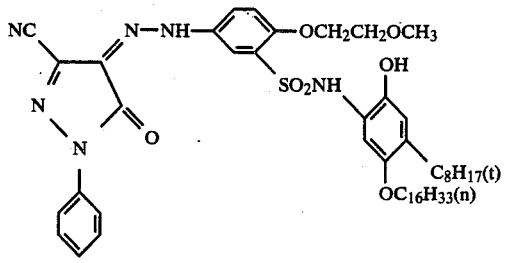

(E)

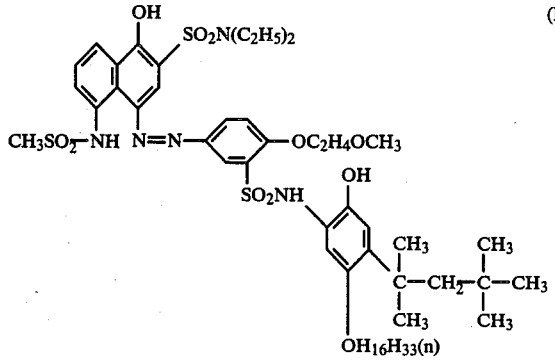

We claim:

1. A process for forming an image, comprising imagewise exposing a photosensitive material comprising on a support a photosensitive silver halide, a sensitizing dye having general formula (I) and/or (II) as defined below, and a compound which forms or releases a mobile dye in proportion or counterproportion to the reduction of the photosensitive silver halide into silver by heating, and transferring the resulting mobile dye to a dye-fixing element in the presence of a hydrophilic solvent as a dye transfer assistant, said hydrophilic solvent consisting essentially of water, wherein formula (I) is:

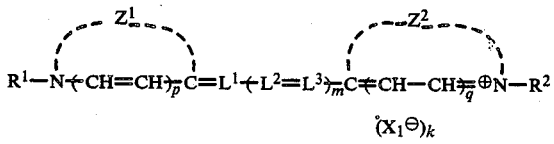

wherein $Z^1$ and $Z^2$ individually represent a group of non-metallic atoms necessary to form a 5- or 6-membered heterocyclic ring, $Z^1$ and $Z^2$ may be the same or different, $R^1$ and $R^2$ individually represent a substituted or unsubstituted alkyl group, $R^1$ and $R^2$ may be the same or different, $L^1$, $L^2$ and $L^3$ individually represent a substituted or unsubstituted methine group, p and q are individually equal to 0 or 1, m is equal to 0, 1, 2, or 3, $X_1\ominus$ represents an anion, k is equal to 0 or 1, with the proviso that the number of organic acid groups contained in the molecular except $X_1\ominus$ is up to 1, and formula (II) is:

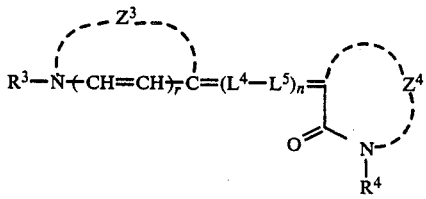

wherein $Z^3$ has the same meaning as $Z^1$ and $Z^2$, $R^3$ has the same meaning as $R^1$ and $R^2$ except an alkyl group having an acid group, $L^4$ and $L^5$ have the same meaning as $L^1$, $L^2$, and $L^3$, $Z^4$ represents a group of non-metallic atoms necessary to form a 5- or 6-membered heterocyclic ring, $R^4$ represents a hydrogen atom, or a substituted or unsubstituted alkyl, aryl or heterocyclic group, r has the same meaning as p and q, and n has the same meaning as m, wherein the imagewise exposed photosensitive material is heated to develop the imagewise exposed photosensitive material.

2. The process of claim 1 wherein the heterocyclic ring formed by each of $Z^1$ and $Z^2$ has a thiazole nucleus, benzothiazole nucleus, naphthothiazole nucleus, thiazoline nucleus, oxazole nucleus, benzoxazole nucleus, naphthoxazole nucleus, oxazoline nucleus, selenazole nucleus, benzoselenazole nucleus, naphthoselenazole nucleus, 3,3-dialkylindolenine nucleus, imidazole nucleus, pyridine nucleus, quinoline nucleus, imidazo[4,5-b]quinoxaline nucleus, oxadiazole nucleus, thiadiazole nucleus, tetrazole nucleus, or pyrimidine nucleus.

3. The process of claim 1 wherein $R^1$ and $R^2$ independently represent a substituted or unsubstituted alkyl group having 1 to 18 carbon atoms.

4. The process of claim 1 wherein X1⊖ represents a halogen ion, substituted arylsulfonate ion, or alkoxysulfonate ion.

5. The process of claim 1 wherein the heterocyclic ring formed by $Z^3$ has a thiazole nucleus, benzothiazole nucleus, naphthothiazole nucleus, thiazoline nucleus, oxazole nucleus, benzoxazole nucleus, naphthoxazole nucleus, oxazoline nucleus, selenazole nucleus, benzoselenazole nucleus, naphthoselenazole nucleus, 3,3-dialkylindolenine nucleus, imidazole nucleus, pyridine nucleus, quinoline nucleus, imidazo[4,5-b]quinoxaline nucleus, oxadiazole nucleus, thiadiazole nucleus, tetrazole nucleus, or pyrimidine nucleus.

6. The process of claim 1 wherein $R^3$ represents a substituted or unsubstituted alkyl group having 1 to 18 carbon atoms except the alkyl groups having an acid group.

7. The process of claim 1 wherein the heterocyclic ring formed by $Z^4$ has a rhodanine nucleus, 2-thiohydantoin nucleus, 2-thioxoxazolidin-4-one nucleus, 2-pyrazolin-5-one nucleus, barbituric acid nucleus, 2-thiobarbituric acid nucleus, thiazolidin-2,4-dione nucleus, thiazolidin-4-one nucleus, isooxazolone nucleus, hydantoin nucleus, or indanedione nucleus.

8. The process of claim 1 wherein $R^4$ represents a hydrogen atom, unsubstituted alkyl group having 1 to 18 carbon atoms, substituted alkyl group having 1 to 20 carbon atoms, unsubstituted aryl group having 6 to 20 carbon atoms, substituted aryl group having 6 to 24 carbon atoms, or substituted or unsubstituted heterocyclic group.

9. The process of claim 1, wherein the hydrophilic solvent is water per se.

10. The process of claim 1, wherein the sensitizing dye has general formula (I).

11. The process of claim 10, wherein the sensitizing dye has general formula (II).

* * * * *